US008744286B2

(12) United States Patent
Tomaru

(10) Patent No.: US 8,744,286 B2
(45) Date of Patent: Jun. 3, 2014

(54) IMAGE FORMATION APPARATUS THAT PERFORMS A FIRST CONSUMED-AMOUNT CALCULATION MODE OR A SECOND CONSUMED-AMOUNT CALCULATION MODE BASED ON A TONER AMOUNT

(75) Inventor: Masashi Tomaru, Tokyo (JP)

(73) Assignee: Oki Data Corporation, Tokyo (JP)

( * ) Notice: Subject to any disclaimer, the term of this patent is extended or adjusted under 35 U.S.C. 154(b) by 193 days.

(21) Appl. No.: 13/401,317

(22) Filed: Feb. 21, 2012

(65) Prior Publication Data

US 2012/0213538 A1 Aug. 23, 2012

(30) Foreign Application Priority Data

Feb. 23, 2011 (JP) ..... 2011-037485

(51) Int. Cl.
*G03G 15/00* (2006.01)

(52) U.S. Cl.
USPC ..... 399/24; 299/25; 299/26

(58) Field of Classification Search
USPC ..... 399/24–27
See application file for complete search history.

(56) References Cited

U.S. PATENT DOCUMENTS

| | | | | |
|---|---|---|---|---|
| 5,717,974 | A * | 2/1998 | Park | 399/24 |
| 5,802,419 | A * | 9/1998 | Sakurai et al. | 399/26 |
| 5,850,583 | A * | 12/1998 | Song et al. | 399/24 |
| 6,853,463 | B2 * | 2/2005 | Oshima | 358/1.9 |
| 2001/0055493 | A1 * | 12/2001 | Asanuma et al. | 399/25 |
| 2005/0117918 | A1 * | 6/2005 | Kimura et al. | 399/8 |
| 2005/0254830 | A1 * | 11/2005 | Maeda | 399/10 |
| 2011/0026968 | A1 * | 2/2011 | Ishii et al. | 399/111 |

FOREIGN PATENT DOCUMENTS

JP 2006-023537 A 1/2006

* cited by examiner

*Primary Examiner* — G. M. Hyder
(74) *Attorney, Agent, or Firm* — Marvin A. Motsenbocker; Mots Law, PLLC

(57) ABSTRACT

An image formation apparatus includes a toner cartridge, a toner-amount detector configured to detect a toner amount in the toner cartridge, a display unit, and an analyzer. The analyzer is configured to make the display unit display a used condition of the image formation apparatus when the image formation apparatus is in a small-amount mode where the toner amount is smaller than a threshold.

16 Claims, 22 Drawing Sheets

232A

| COUNTER | | |
|---|---|---|
| NUMBER OF ROTATIONS MADE BY PHOTOSENSITIVE MEMBER | 14200 | 232B |
| NUMBER OF ROTATIONS AT START OF EMPTY MODE | 14000 | 232C |
| EMPTY-MODE MAXIMUM NUMBER OF ROTATION | 15000 | 232D |
| NUMBER OF ROTATIONS PER JOB | 100 | 232E |
| DOT-COUNT NUMBER PER JOB | 20000000 | 232F |
| NUMBER OF PRINTED SHEETS PER JOB | 1 | 232G |

FIG. 2

132A

| COUNTER | | |
|---|---|---|
| NUMBER OF ROTATIONS MADE BY PHOTOSENSITIVE MEMBER | 14200 | 132B |
| NUMBER OF ROTATIONS AT START OF EMPTY MODE | 14000 | 132C |
| EMPTY-MODE MAXIMUM NUMBER OF ROTATIONS | 15000 | 132D |

FIG. 12

232A

| COUNTER | | |
|---|---|---|
| NUMBER OF ROTATIONS MADE BY PHOTOSENSITIVE MEMBER | 14200 | 232B |
| NUMBER OF ROTATIONS AT START OF EMPTY MODE | 14000 | 232C |
| EMPTY-MODE MAXIMUM NUMBER OF ROTATION | 15000 | 232D |
| NUMBER OF ROTATIONS PER JOB | 100 | 232E |
| DOT-COUNT NUMBER PER JOB | 20000000 | 232F |
| NUMBER OF PRINTED SHEETS PER JOB | 1 | 232G |

FIG. 16

332A

| COUNTER | |
|---|---|
| NUMBER OF ROTATIONS MADE BY PHOTOSENSITIVE MEMBER | 14200 |

332B

FIG. 18

432A

| COUNTER | | |
|---|---|---|
| NUMBER OF ROTATIONS MADE BY PHOTOSENSITIVE MEMBER | 14200 | 432B |
| NUMBER OF ROTATIONS AT START OF EMPTY MODE | 14000 | 432C |
| EMPTY-MODE MAXIMUM NUMBER OF ROTATION | 15000 | 432D |
| NUMBER OF ROTATIONS PER JOB | 100 | 432E |
| DOT-COUNT NUMBER PER JOB | 20000000 | 432F |
| NUMBER OF PRINTED SHEETS PER JOB | 1 | 432G |
| ACCUMULATED VALUE OF ADDITIONAL DAMAGE VALUE | 200 | 432H |

FIG. 21

132E

| COUNTER | | |
|---|---|---|
| NUMBER OF ROTATIONS MADE BY PHOTOSENSITIVE MEMBER | 13400 | 132F |
| NUMBER OF ROTATIONS AT START OF EMPTY MODE | 13000 | 132G |
| MAXIMUM NUMBER OF ROTATION | 20000 | 132H |

IMAGE FORMATION APPARATUS THAT PERFORMS A FIRST CONSUMED-AMOUNT CALCULATION MODE OR A SECOND CONSUMED-AMOUNT CALCULATION MODE BASED ON A TONER AMOUNT

CROSS REFERENCE TO RELATED APPLICATIONS

This application claims priority based on 35 USC 119 from prior Japanese Patent Application No. 2011-037485 filed on Feb. 23, 2011, entitled "IMAGE FORMATION APPARATUS", the entire contents of which are incorporated herein by reference.

BACKGROUND OF THE INVENTION

1. Field of the Invention

The invention relates to an image formation apparatus.

2. Description of Related Art

A conventional image formation apparatus rotates a rotatably supported shaft in a toner cartridge that stores therein toner to agitate the toner stored in the toner cartridge. Japanese Patent Application Laid-open No. 2006-23537 discloses a technique by which the amount of toner that remains in the toner cartridge is detected by using a sensor to sense the rotational speed of the shaft.

SUMMARY OF THE INVENTION

The conventional technique can detect the amount of toner that remains in the toner cartridge, but cannot detect the used condition of the image formation apparatus including conditions of consumable components other than the toner. Thus, an object of the invention is to provide an image formation apparatus capable of detecting a used condition of the image formation apparatus.

An aspect of the invention is an image formation apparatus including: a toner cartridge; a toner-amount detector configured to detect a toner amount in the toner cartridge; a display unit; and an analyzer. The analyzer is configured to make the display unit display a used condition of the image formation apparatus, when the image formation apparatus is in a small-amount mode where the toner amount is smaller than a threshold.

According to the aspect, the used condition of the image formation apparatus can be detected sufficiently.

BRIEF DESCRIPTION OF THE DRAWINGS

FIG. 2 is a schematic diagram illustrating the configuration of a counter according to the first embodiment.

FIG. 12 is a schematic diagram illustrating the configuration in a counter according to the second embodiment.

FIG. 16 is a schematic diagram illustrating the configuration of a counter according to the third embodiment.

FIG. 18 is a schematic diagram illustrating the configuration of a counter according to a modification.

FIG. 21 is a schematic diagram illustrating the configuration of a counter according to the fourth embodiment.

DETAILED DESCRIPTION OF EMBODIMENTS

Figure 1:
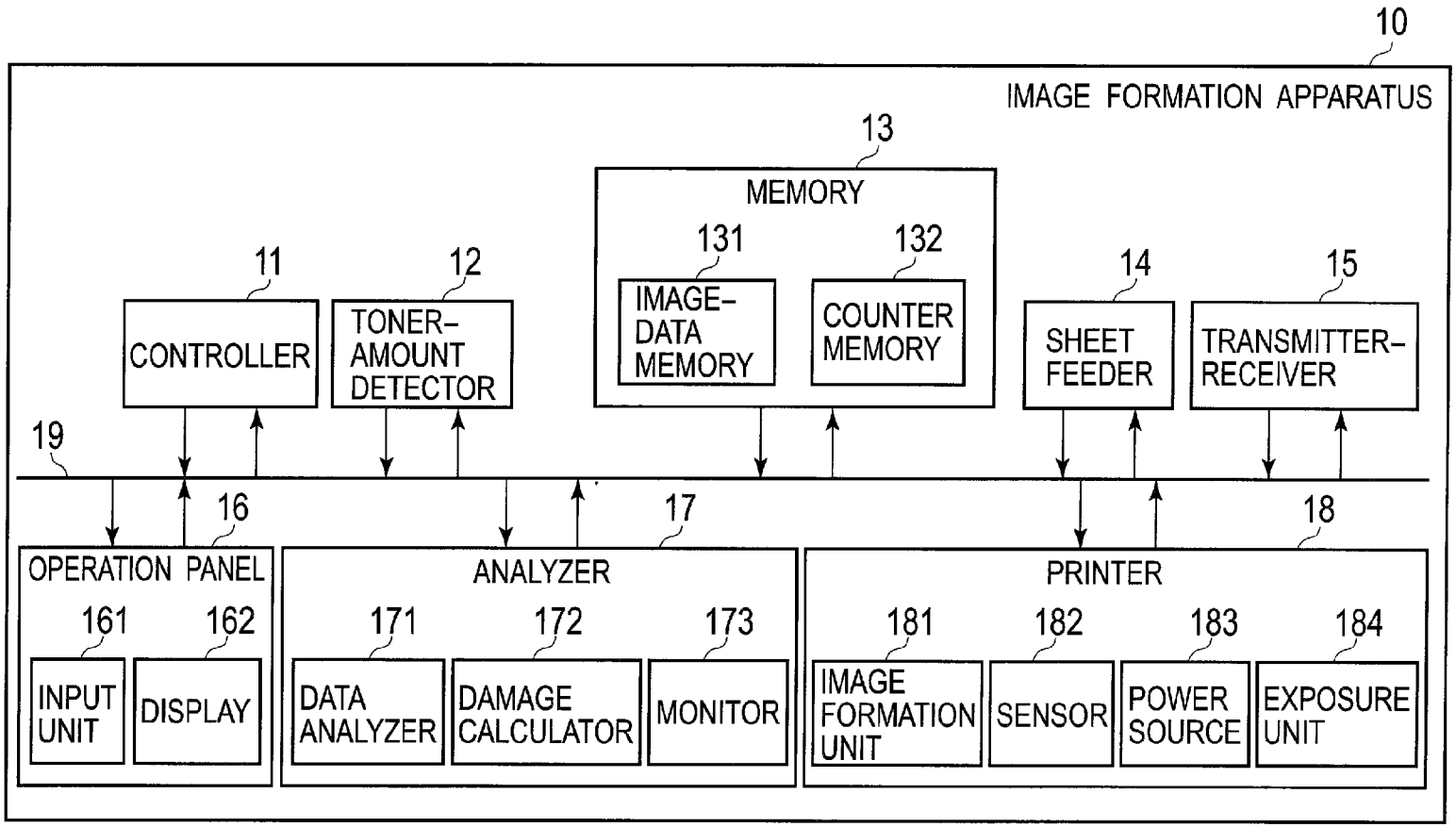
FIG. 1 is a block diagram schematically illustrating the overall configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a block diagram schematically illustrating the configuration of image formation apparatus 10 according to a first embodiment. Image formation apparatus 10 includes controller 11, toner-amount detector 12, memory 13, sheet feeder 14, transmitter-receiver 15, operation panel 16, analyzer 17, printer 18, and bus 19 that connects the above-mentioned members to one another.

Controller 11 performs an overall control of the operations of the other components of image formation apparatus 10. In addition, controller 11 counts the number of rotations made by photosensitive member 1811A (see FIG. 3) included in printer 18, and then updates the number of rotations made by photosensitive member 1811A stored in counter memory 232. On the basis of the detection result obtained by sensor 182 included in printer 18, toner-amount detector 12 detects the amount of toner (remaining toner) that remains in toner cartridge 1812 (see FIG. 3). Memory 13 stores information that is necessary for image formation apparatus 10 to perform various processes. In this first embodiment, memory 13 includes image-data memory 131 and counter memory 132. Image-data memory 131 stores image data for printing by image formation apparatus 10. Counter memory 132 has counter 132A (see FIG. 2) that stores the number of rotations made by photosensitive member (photosensitive-member drum) 1811A included in printer 18.

FIG. 2 is a schematic diagram illustrating the configuration of counter 132A. Counter 132A has photosensitive member rotation count cell 132B, empty-mode-start-time rotation count cell 132C, and empty-mode maximum rotation count cell 132D. Photosensitive member rotation count cell 132B stores the number of rotations made by the photosensitive member, that is, the number of rotations made by photosensitive member 1811A (see FIG. 3) of image drum unit 1811 (see FIG. 3) included in printer 18 after the start of using image drum unit 1811 (after the replacement of a used image drum unit with a new image drum unit). Note that the value in photosensitive member rotation count cell 132B is reset to the initial value ("zero," for instance) when image drum unit is replaced. Empty-mode-start-time rotation count cell 132C stores the number of rotations at the start of an empty mode, that is, the number of rotations made by photosensitive member 1811A after the start of using photosensitive member 1811A until the operation mode of image formation apparatus 10 is switched to the empty mode where the amount of toner is less than a predetermined toner-amount threshold. Empty-mode maximum rotation count cell 132D stores an empty-mode maximum number of rotations, which is set at the start of the empty mode, and indicates the maximum number of rotations that can be made by photosensitive member 1811A without damaging image drum unit 1811 after the start of the use of particular image drum unit 1811. In this embodiment, the empty-mode maximum number of rotations (specifically, 15000 rotations in FIG. 2) is a value obtained by adding a predetermined number of rotations (e.g., 1000 rotations) to the number of rotations at the start of the empty mode (specifically, 14000 rotations in FIG. 2). The added predetermined number of rotations (specifically, 1000 rotations in this first embodiment) is the maximum number of rotations that can be made by photosensitive member 1811A without damaging image drum unit 1811 after the start of the empty mode (i.e., the maximum number of rotations of photosensitive member 1811A in the empty mode). If image drum unit 1811 is damaged, the accurate consumption rate of image drum unit 1811 may fail to be identified.

Sheet feeder 14 supplies sheets of recording paper as the print media subjected to the printing in printer 18. Transmitter-receiver 15 transmits and receives data to and from an external apparatus. For example, transmitter-receiver 15 receives, from an external apparatus, the image data for the printing. Operation panel 16 is an operation panel, and includes input unit 161 and display unit 162. Input unit 161 corresponds to an input device, such as a touch panel and a keyboard, which is operated by the user of image formation apparatus 10 to input instructions and information into image formation apparatus 10. Display unit 162 corresponds to a display apparatus such as a display.

Analyzer 17 is a unit configured to analyze the used condition of image formation apparatus 10 and includes data analyzer 171, damage calculator 172 serving as a progress-degree calculator, and monitor 173. Data analyzer 171 analyzes the image data received by transmitter-receiver 15. Damage calculator 172 calculates a damage-progress rate. The damage-progress rate is a progress rate up to a serviceability limit point in the empty mode at which further continuous use of the image drum unit in the empty mode may damage the image drum unit. The damage-progress rate increases as the number of rotations made by photosensitive member 1811A in the empty mode increases. How to calculate the damage-progress rate will be described later. Monitor 173 monitors the used condition of image formation apparatus 10. In addition, monitor 173 performs the processes to update both the number of rotations at the start of the empty mode and the empty-mode maximum number of rotations, both of these numbers being stored in counter 132A. Furthermore, monitor 173 creates a screen containing the information on the used condition of image formation apparatus 10, and makes display unit 162 display the created screen.

Printer 18 prints images corresponding to the image data analyzed by data analyzer 171. For example, printer 18 includes image formation unit 181, sensor 182, power source 183, and exposure unit 184.

Figure 3:
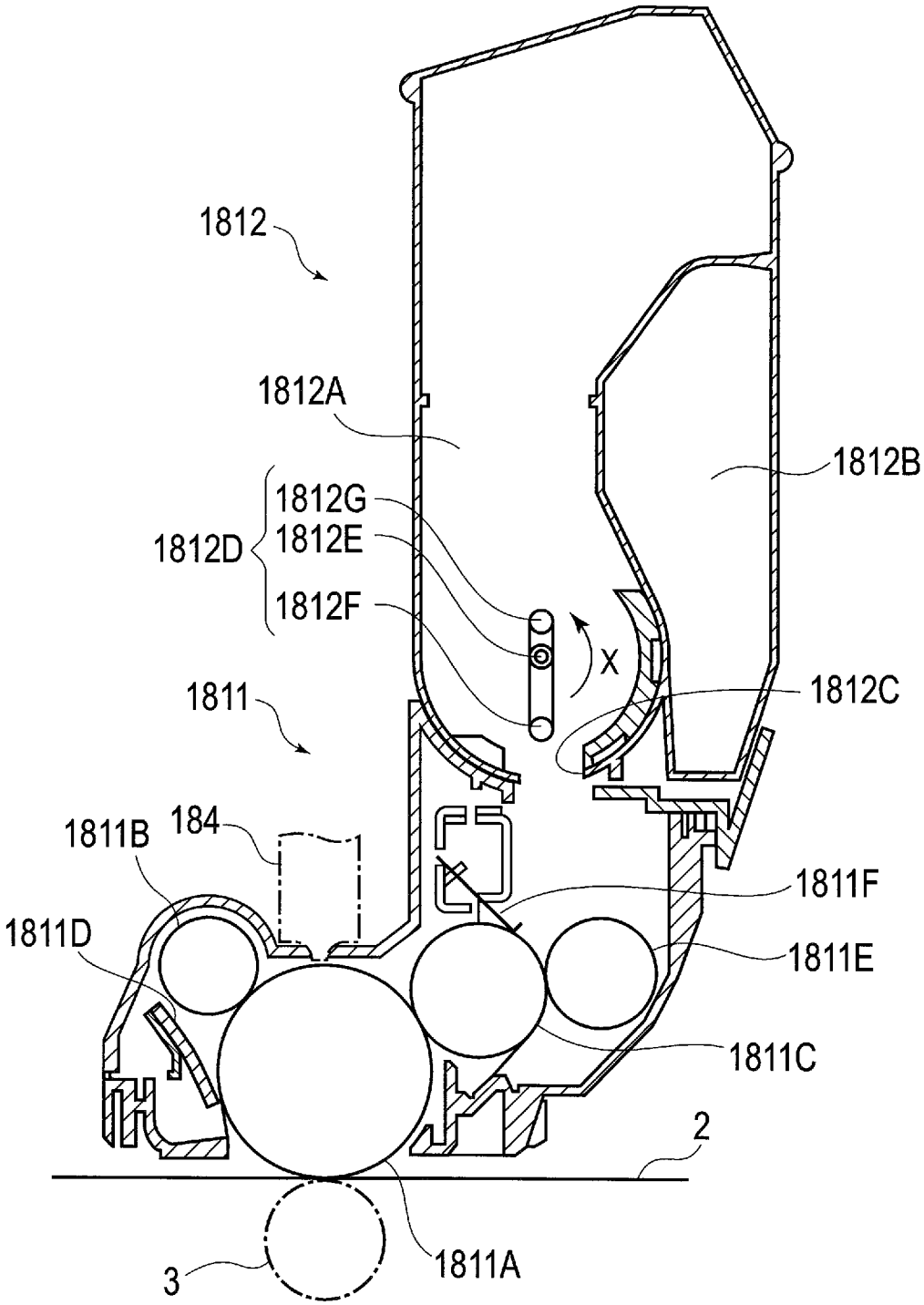
FIG. 3 is a vertical, cross-sectional view schematically illustrating the configuration of an image formation unit according to the first embodiment.

FIG. 3 is a vertical, cross-sectional view schematically illustrating the configuration of image formation unit 181 included in printer 18. Image formation unit 181 includes image drum unit 1811 and toner cartridge 1812.

Image drum unit 1811 includes photosensitive member 1811A, charger roller 1811B, development roller 1811C, cleaning blade 1811D, toner-supply roller 1811E, and development blade 1811F. Note that photosensitive member 1811A, charger roller 1811B, development roller 1811C, and toner-supply roller 1811E are rotating members that rotate when images are printed. Electrical charges can be accumulated on the surface of photosensitive member 1811A. The surface of photosensitive member 1811A is electrically charged uniformly at a certain potential by charger roller 1811B. On the electrically-charged surface of photosensitive member 1811A, an electrostatic latent image is formed by the exposure with light projected by exposure unit 184. Then, toner adheres to the electrostatic latent image formed on the surface of photosensitive member 1811A, and thereby a toner image is formed on the surface of photosensitive member 1811A. Then, the toner image formed on the surface of photosensitive member 1811A is transferred, by transfer roller 3, onto the surface of the sheet of recording paper transported by transfer belt 2. Charger roller 1811B electrically charges uniformly the surface of photosensitive member 1811A at a certain potential. Development roller 1811C supplies the toner to the surface of photosensitive member 1811A. Cleaning blade 1811D scrapes off the toner that remains on the surface of photosensitive member 1811A. Toner-supply roller 1811E supplies, to development roller 1811C, the toner discharged from toner cartridge 1812. Development blade 1811F makes the thickness of a layer of toner uniform on the surface of development roller 1811C.

Toner cartridge 1812 includes toner tank 1812A and toner collector 1812B. Toner tank 1812A stores unused toner and discharges the toner stored therein into image drum unit 1811 through toner outlet 1812C at a lower portion of the toner tank 1812A. Toner-agitation bar 1812D is provided in toner tank 1812A and includes rotary shaft 1812E, first crank portion 1812F, and second crank portion 1812G. Rotary shaft 1812E receives driving force supplied by power source 183 (see FIG. 1), and thus rotates in a single direction. e.g., in the X-direction shown in FIG. 3. As rotary shaft 1812E rotates, first crank portion 1812F rotates in toner tank 1812A and thereby agitates the toner in toner tank 1812A. Specifically, along with the rotation of rotary shaft 1812E, first crank portion 1812F is raised up to the top dead point and then falls down under its own weight when there remains only a small amount of toner in toner tank 1812A. Hence, when the amount of toner in toner tank 1812A becomes small, a length of time for toner-agitation bar 1812D to rotate a full circle is shorter compared with the cycle of power source 183 needed to make rotary shaft 1812E rotate at a constant speed. Accordingly, by making sensor 182 (see FIG. 1) detect the rotary actions of toner-agitation bar 1812D and thus measure the length of time that is necessary for toner-agitation bar 1812D to rotate a full circle, toner-amount detector 12 can detect the toner amount in toner cartridge 1812 on the basis of the length of time thus measured.

Referring back to FIG. 1, sensor 182 detects the actions of toner-agitation bar 1812D. For example, when first crank portion 1812E is at a certain predetermined position, sensor 182 outputs a detection signal to toner-amount detector 12. Thus, toner-amount detector 12 can measure the length of time needed for toner-agitation bar 1812D to rotate a full circle.

Power source 183 supplies the driving force to rotary shaft 1812E. Exposure unit 184 performs an exposure to illuminate photosensitive member 1811A in accordance with the image data for the printing.

Figure 4:
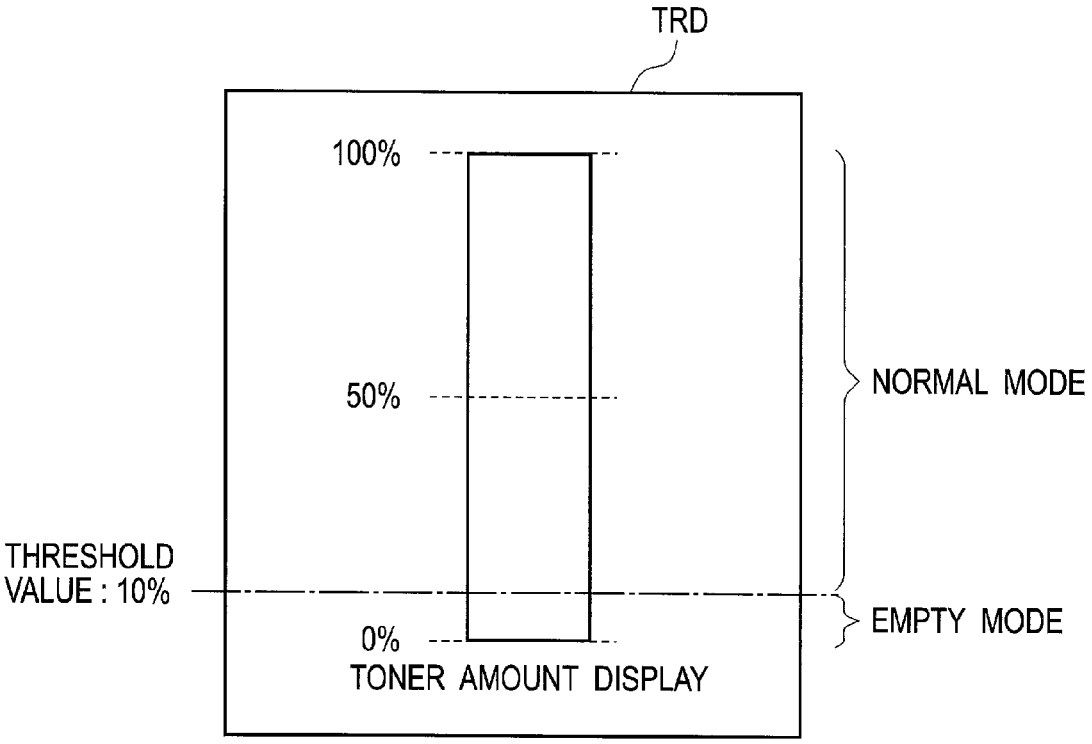
FIG. 4 is a schematic diagram of an example of a remaining-toner-amount display according to the first embodiment.

FIG. 4 is a schematic diagram illustrating an example of toner-rate display screen TRD that displays the toner amount in toner tank 1812A. The toner amount in toner tank 1812A is detected by toner-amount detector 12, and is displayed in percent figures. When the toner amount is 100%, toner amount is at the maximum amount. When the toner amount is 0%, no toner is left in toner tank 1812A (i.e., the toner amount in toner tank 1812A is zero). Generally, in image formation apparatus 10, the toner amount decreases gradually from 100%. Once the toner amount falls below a toner-amount threshold (a predetermined amount, e.g., 10%), monitor 173 of image formation apparatus 10 judges that image formation apparatus 10 is in the empty mode. Note that when the toner amount is equal to or greater than 10%, image formation apparatus 10 is in the normal mode. On the basis of the toner amount detected by toner-amount detector 12, monitor 173 creates toner-rate display screen TRD such as one shown in FIG. 4, and makes display unit 162 display toner-rate display screen TRD thus created.

Figure 5:
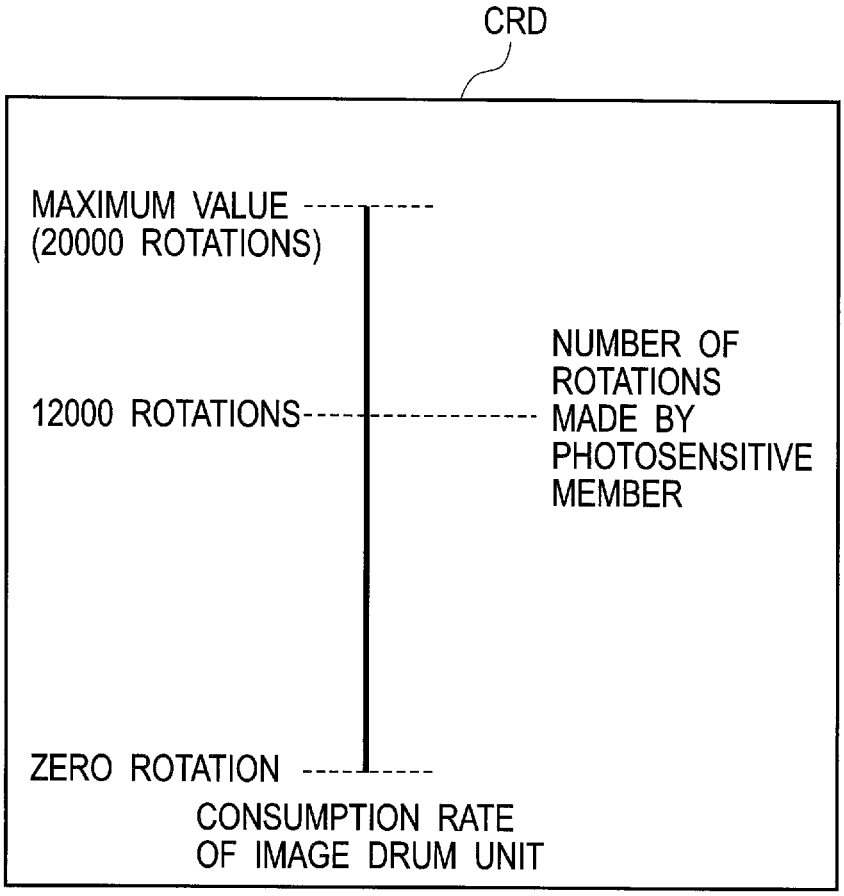
FIG. 5 is a schematic diagram of a display screen showing how to manage the consumption rate of an image drum unit according to the first embodiment.

FIG. 5 is a schematic diagram illustrating an example of consumption-rate display screen CRD displaying the consumption rate of image drum unit 1811. Image drum unit 1811 is a kind of consumable component that degrades as photosensitive member 1811A rotates. The consumption rate of image drum unit 1811 can be judged on the basis of the number of rotations made by photosensitive member 1811A. When the number of rotations made by photosensitive member 1811A is zero, image drum unit 1811 is brand-new. When the number of rotations made by photosensitive member 1811A reaches the maximum value (e.g., 20000 rotations in FIG. 5), the service life of image drum unit 1811A expires. Every time image photosensitive member 1811A rotates in the print process performed by image formation apparatus 10, the number of rotations made by photosensitive member 1811A increases. In the case shown by the display example in FIG. 5, the number of rotations made by photosensitive member 1811A is 12000 rotations, meaning that the service life has not yet expired. On the basis of the number of rotations made by photosensitive member 1811A stored in counter memory 132, monitor 173 creates consumption-rate display screen CRD such as one shown in FIG. 5, and makes display unit 162 display consumption-rate display screen CRD thus created. Note that monitor 173 preferably makes display unit 162 display consumption-rate display screen CRD such as one shown in FIG. 5 when the toner amount detected by toner-amount detector 12 becomes smaller than the toner-amount threshold.

Figure 6:
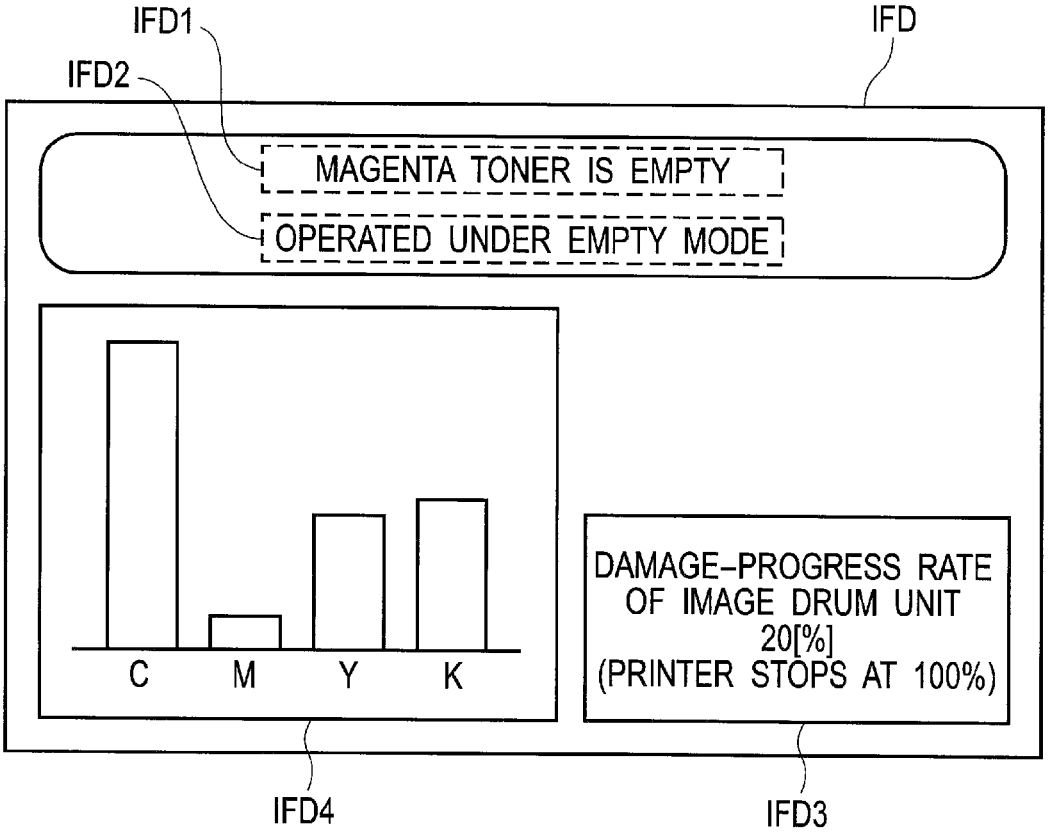
FIG. 6 is an example of an information display screen for the progress rate of the damage of an image drum unit according to the first embodiment.

FIG. 6 is a schematic diagram illustrating information screen IFD for damage-progress rate of image drum unit 1811. Information screen IFD for the damage-progress rate is displayed by display unit 162 when the operation mode of image formation apparatus 10 is switched to the empty mode. Information screen IFD includes: message display section IFD1 that notifies the user of the fact that only a small amount of toner is left in toner tank 1812A; status display section IFD2 that notifies the user of the status (empty mode herein) of image formation apparatus 10; damage-progress rate display section IFD3 that notifies the user of the current damage-progress rate of image drum unit 1811; and toner-amount display section IFD4 that notifies the user of the amount of toner left in toner tank 1812A.

Next, description is given of the operations of image formation apparatus 10. In image formation apparatus 10, transmitter-receiver 15 receives the image data, then data analyzer 171 analyzes the received image data, and then printer 18 prints a print image of the analyzed image data. If, in the above-described course of operations, toner-amount detector 12 detects that the amount of toner stored in toner cartridge 1812 becomes less than the toner-amount threshold, controller 11 operates image formation apparatus 10 in the empty mode. In the empty mode, damage calculator 172 calculates the damage-progress rate of image drum unit 1811 on the basis of the number of rotations made by the photosensitive member, the number of rotations at the start of the empty mode, and the empty-mode maximum number of rotations that are stored in counter 132A. Thus, monitor 173 identifies the information on the used condition of image formation apparatus 10 including at least the damage-progress rate of image drum unit 1811, and then notifies the user of the used condition through display unit 162.

Figure 7:
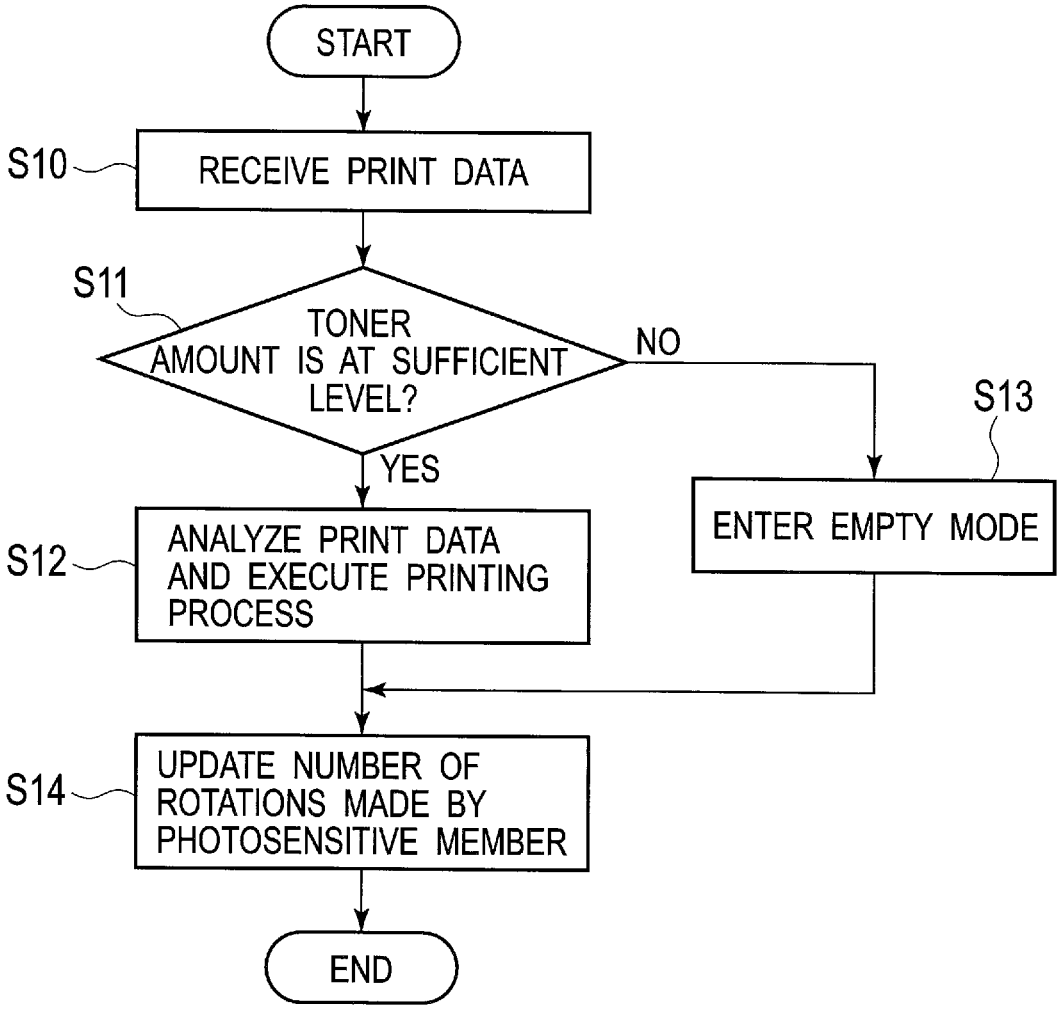
FIG. 7 is a flowchart illustrating processes performed by the image formation apparatus according to the first embodiment to detect the toner amount and then, if appropriate, to switch the operation mode of the image formation apparatus on the basis of the detection result.

FIG. 7 is a flowchart illustrating processes performed by image formation apparatus 10 according to the first embodiment to detect the toner amount in toner cartridge 1812 and then switch the operation mode, if appropriate, of image formation apparatus 10 on the basis of the detection result.

Firstly, transmitter-receiver 15 receives the image data (S10). Then, toner-amount detector 12 detects the amount of toner stored in toner cartridge 1812, and judges whether or not the detected toner amount is equal to or larger than the toner-amount threshold (S11).

If toner-amount detector 12 judges that the detected toner amount is equal to or larger than the toner-amount threshold (Yes at step S11), data analyzer 171 analyzes the image data, and printer 18 prints a print image of the analyzed image data (S12).

If, in contrast, toner-amount detector 12 judges that the detected toner amount is smaller than the toner-amount threshold (No at step S11), controller 11 switches the operation mode of image formation apparatus 10 from the normal mode to the empty mode, and executes the processes in the empty mode (S13).

Then, on the basis of the number of rotations made by photosensitive member 1811A at step S12 or step S13, controller 11 updates the number of rotations made by photosensitive member 1811A kept in counter 132A (S14). For example, controller 11 adds the number of rotations made by photosensitive member 1811A at step S12 or step S13 to the value in photosensitive member rotation count cell 132B in counter 132A.

Figure 8:
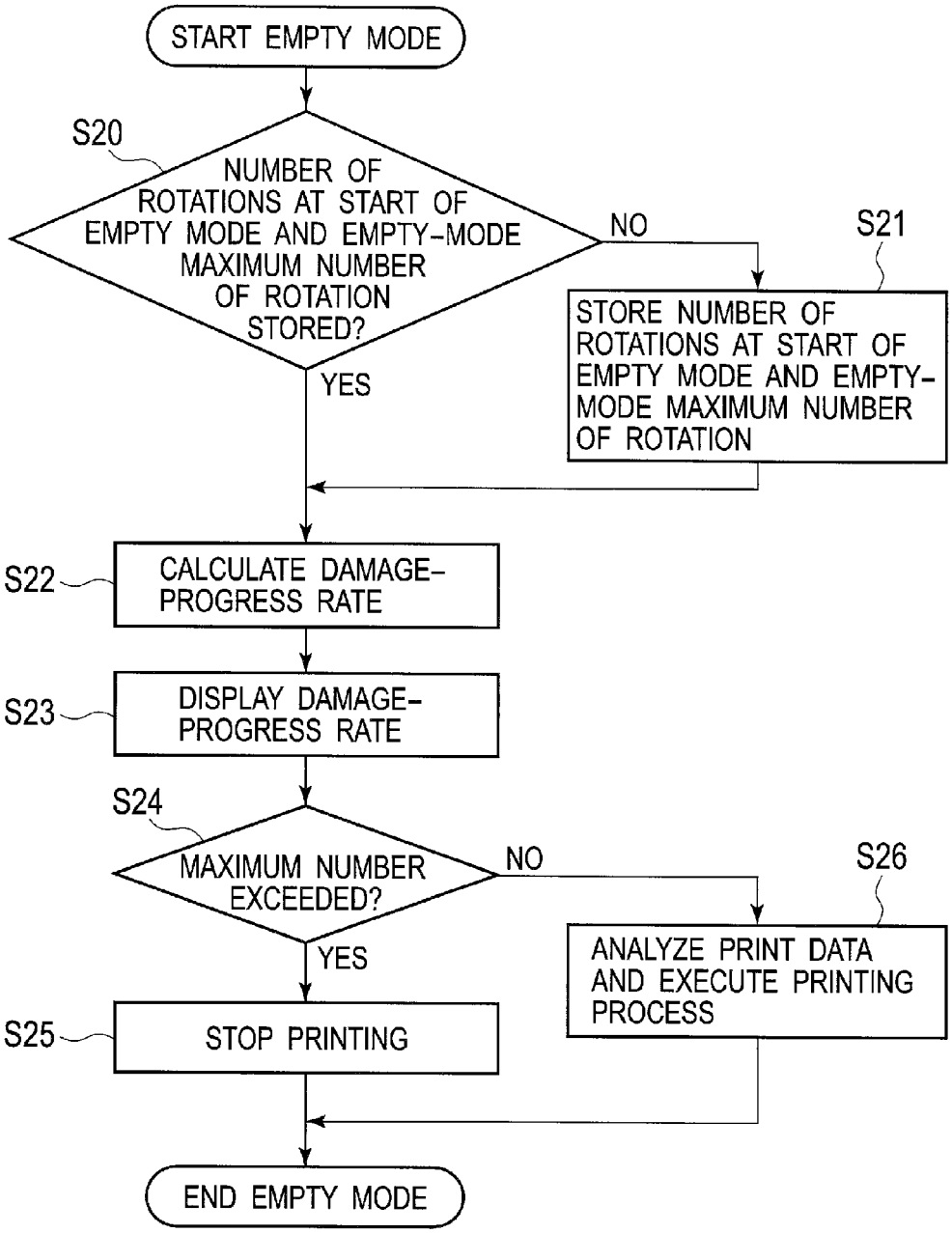
FIG. 8 is a flowchart illustrating processes performed by the image formation apparatus according to the first embodiment when the image formation apparatus is in an empty mode as a small toner amount mode.

FIG. 8 is a flowchart illustrating processes performed by image formation apparatus 10 according to the first embodiment in the empty mode.

Firstly, damage calculator 172 judges whether or not counter 132A keeps both the number of rotations at the start of the empty mode and the empty-mode maximum number of rotations (S20). For example, if values in empty-mode-start-time rotation count cell 132C and empty-mode maximum rotation count cell 132D in counter 132A are both "NULL", damage calculator 172 judges that the numbers are not stored.

Then if damage calculator 172 judges that neither the number of rotations at the start of the empty mode nor the empty-mode maximum number of rotations is stored in counter 132A (No at step S20), monitor 173 stores both the number of rotations at the start of the empty mode and the empty-mode maximum number of rotations in counter 132A (S21). For example, monitor 173 puts the value kept in photosensitive member rotation count cell 132B of counter 132A at the beginning of the empty mode in number of rotations at the start of the empty mode cell 132C as the number of rotations at the start of the empty mode. In addition, monitor 173 calculates the empty-mode maximum number of rotations by adding a predetermined number of rotations (e.g., 1000) to this number of rotations at the start of the empty mode. Then, the calculated empty-mode maximum number of rotations is stored in empty-mode maximum rotation count cell 132D.

If, in contrast, damage calculator 172 judges that counter 132A stores both the number of rotations at the start of the empty mode and the empty-mode maximum number of rotations (Yes at step S20), or if the process at step S21 is performed, damage calculator 172 calculates the damage-progress rate of image drum unit 1811 on the basis of the number of rotations made by the photosensitive member, the number of rotations at the start of the empty mode, and the empty-mode maximum number of rotations that are stored in counter 132A (S22). For example, damage calculator 172 calculates the damage-progress rate with the following formula (1).

[Equation 1]

$$[\{(\text{Number of rotations made by photosensitive member})-(\text{Number of rotations at start of empty mode})\}/\{(\text{Empty-mode maximum number of rotations})-(\text{Number of rotations at start of empty mode})\}]\times 100=\text{Damage-progress rate} \quad (1)$$

Figure 9:
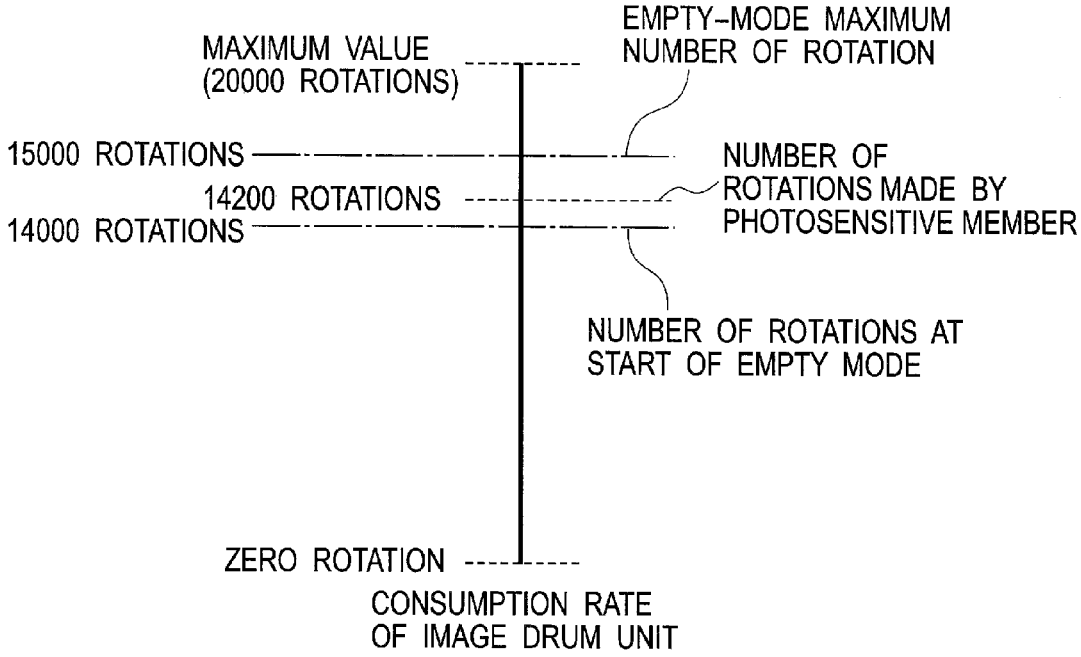
FIG. 9 is a schematic diagram illustrating examples of the number of rotations made by the photosensitive member, the number of rotations at the start of the empty mode, and the empty-mode maximum number of rotations according to the first embodiment.

For example, the damage-progress rate is 20% when the number of rotations made by the photosensitive member is "14200 (rotations)", the number of rotations at the start of the empty mode is "14000 (rotations)", and the empty-mode maximum number of rotations is "15000(rotations)" as shown in FIG. 9.

Then, monitor 173 makes display unit 162 display the used condition of image formation apparatus 10, that is, the damage-progress rate of image drum unit 1811 calculated by damage calculator 172 at step S22 (S23). For example, monitor 173 makes display unit 162 display information screen IFD shown in FIG. 6. Here, monitor 173 preferably makes display unit 162 display not only information screen IFD shown in FIG. 6 but also consumption-rate display screen CRD shown in FIG. 5, either alternately or simultaneously.

Then, monitor 173 judges whether or not the number of rotations in the empty mode exceeds the maximum number (S24). For example, if the damage-progress rate calculated at step S22 is equal to or higher than 100%, monitor 173 judges that the number of rotations in the empty mode exceeds the maximum number (specifically, 1000 rotations in this example).

If monitor 173 judges that the number of rotations in the empty mode exceeds the maximum number (specifically, 1000 rotations in this example) (Yes at step S24), controller 11 stops printing the print image of the image data received by transmitter-receiver 15 (S25). Thus, in the empty mode, controller 11 stops the printing before image drum unit 1811 is damaged. Hence, after returning from the empty mode, the consumption rate of image drum unit 1811 can be identified accurately on the basis of the number of rotations made by photosensitive member 1811A.

If, in contrast, monitor 173 judges that the number of rotations in the empty mode does not exceed the maximum number (specifically, 1000 rotations in this example) (No at step S24), data analyzer 171 analyzes the image data received by transmitter-receiver 15, and printer 18 prints the print image of the analyzed image data (S26).

Figure 10:
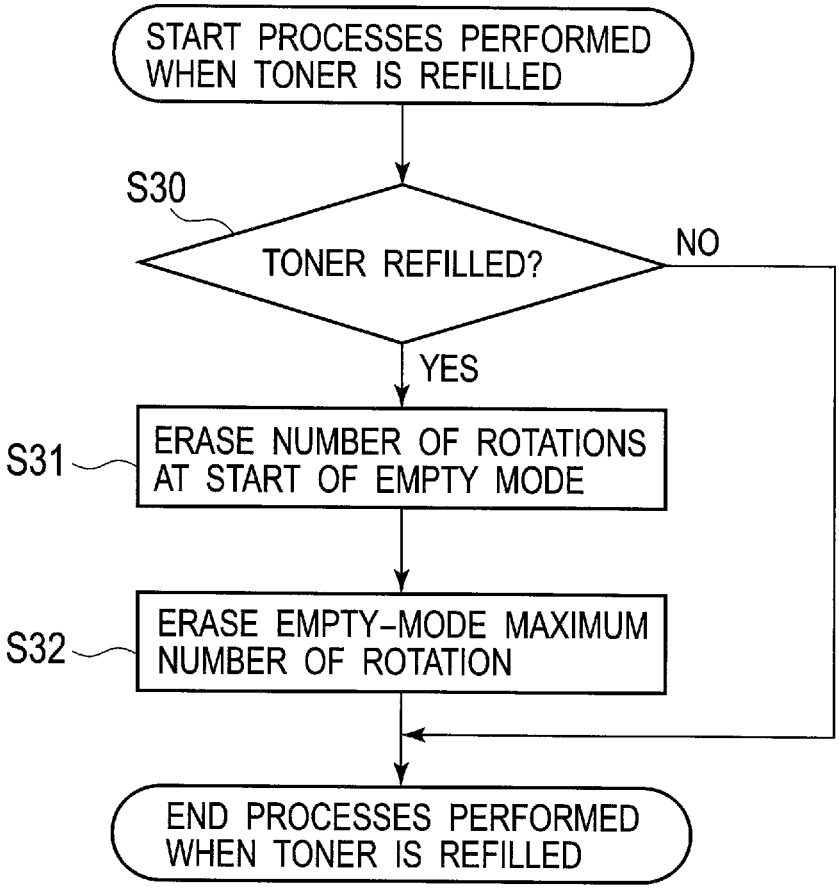
FIG. 10 is a flowchart illustrating processes performed when the toner cartridge is refilled with toner according to the first embodiment.

FIG. 10 is a flowchart illustrating processes to be performed when toner cartridge 1812 is refilled with toner.

Firstly, toner-amount detector 12 detects the amount of toner stored in toner cartridge 1812, and judges whether or not the detected toner amount is equal to or larger than the toner-amount threshold (S30).

If, at step S30, toner-amount detector 12 judges that the toner amount is equal to or larger than the toner-amount threshold (Yes at step S30), monitor 173 erases the number of rotations at the start of the empty mode stored in counter 132A and puts in a value "NULL" instead (S31). Monitor 173 also erases the empty-mode maximum number of rotations stored in counter 132A, and puts in a value "NULL" instead (S32).

In contrast, if, at step S30, toner-amount detector 12 judges that the toner amount is smaller than the toner-amount threshold (No at step S30), monitor 173 terminates the processes.

As has been described thus far, if, in image formation apparatus 10 according to the first embodiment, when the amount of toner stored in toner cartridge 1812 becomes small, the damage-progress rate of image drum unit 1811 is calculated from the number of rotations made by the photosensitive member, and the user is notified of this calculated damage-progress rate as the used condition of image formation apparatus 10. There has always been a problem that if image formation apparatus 10 continues to be used with a small amount of toner, image drum unit 1811 is damaged. Image formation apparatus 10 according to the first embodiment can solve such a problem.

In addition, in image formation apparatus 10 according to the first embodiment, when the amount of toner stored in toner cartridge 1812 becomes small, the user is notified of the consumption rate of image drum unit 1811 as the used condition of image formation apparatus 10. Hence, if the consumption rate of image drum unit 1811 is high, image drum unit 1811 can be replaced along with the replacement of toner cartridge 1812. There has been a problem of frequent replacement of consumable components if there are various consumable components with different replacement cycles, and if one of the consumable components (e.g., image drum unit 1811) needs to be replaced immediately after the replacement of another one (e.g., toner cartridge 1812) of the consumable components. Image formation apparatus 10 according to the first embodiment can solve such a problem.

Second Embodiment

Figure 11:
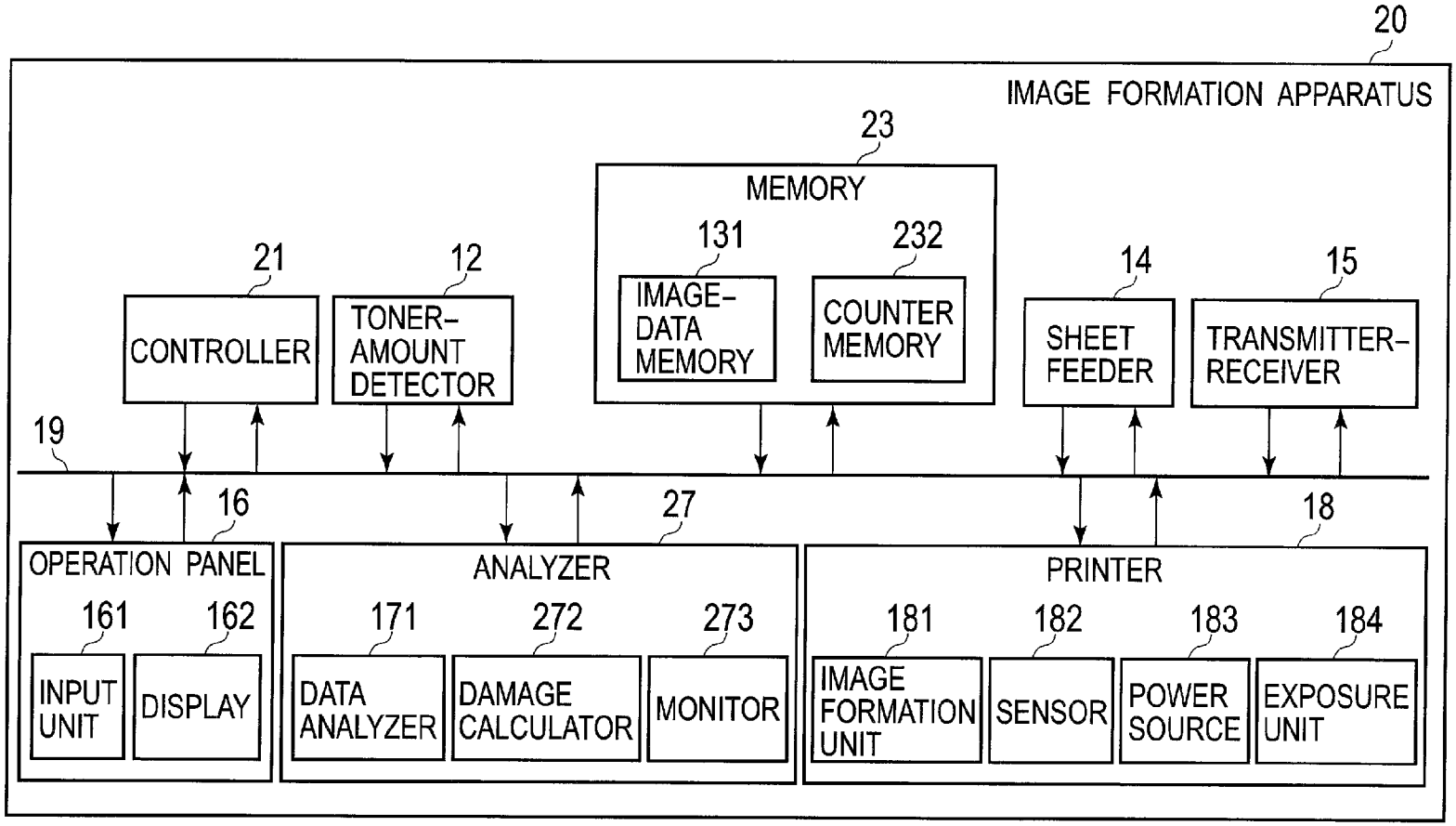
FIG. 11 is block diagram schematically illustrating the overall configuration of an image formation apparatus according to a second embodiment.

FIG. 11 is block diagram schematically illustrating the overall configuration of image formation apparatus 20 according to a second embodiment. As shown in FIG. 11, image formation apparatus 20 includes controller 21, toner-amount detector 12, memory 23, sheet feeder 14, transmitter-receiver 15, operation panel 16, analyzer 27, printer 18, and bus 19 that connects these components to one another. Image formation apparatus 20 according to the second embodiment differs from image formation apparatus 10 according to the first embodiment in that image formation apparatus 20 includes controller 21, memory 23, and analyzer 27. In image formation apparatus 20 according to the second embodiment, damage calculator 272 calculates the damage-progress rate of image drum unit 1811 by adding predetermined values corresponding to the dot-count numbers involved in the print jobs and thus the accuracy of the calculation of the damage-progress rate of image drum unit 1811 is improved. To put it differently, in the first embodiment, the damage-progress rate of image drum unit 1811 is calculated from the number of rotations made by the photosensitive member, the number of rotations at the start of the empty mode, and the empty-mode maximum number of rotations. In contrast, in the second embodiment, the calculation of the damage-progress rate in the second embodiment is also based on an additional damage value in addition to the number of rotations made by the photosensitive member, the number of rotations at the start of the empty mode, and the empty-mode maximum number of rotations. The additional damage value corresponds to dot-count number stored for each executed print job.

Controller 21 in the second embodiment performs an overall control of the operations of the other components of image formation apparatus 20. In addition, controller 21 counts the number of rotations made by a photosensitive member included in printer 18, and then updates the number of rotations made by the photosensitive member stored in counter memory 232. In addition, controller 22 measures the number of rotations per job representing the number of rotations made by the photosensitive member in a single executed print job, the dot-count number per job representing the dot-count number scored in a single executed print job, and the number of printed sheets per job representing the number of printed sheets in a single executed print job. Then, controller 22 updates the number of rotations per job, the dot-count number per job, and the dot-count number per job, stored in the counter memory 232. Note that controller 21 measures the dot-count number per job by, for example, measuring the number of dots illuminated by exposure unit 184 in printer 18 in accordance with the image data. Note also that the number of illuminated dots can be measured by, for example, detecting the On signals and the Off signals as light-emission control signals that are sent to the LED-array head and counting only the On signals.

Memory 23 according to the second embodiment includes image-data memory 131 and counter memory 232. Memory 23 differs from memory 13 according to the first embodiment in the configuration of the counter that is stored in counter memory 232 according to the second embodiment.

Counter memory 232 according to the second embodiment stores information of counter 232A, such as shown in FIG. 12 as one example.

FIG. 12 is a schematic diagram illustrating the configuration of counter 232A. Counter 232A has photosensitive member rotation count cell 232B, empty-mode-start-time rotation count cell 232C, empty-mode maximum rotation count cell 232D, number of rotations per job cell 232E, dot-count number per job cell 232F, and number of printed sheets per job cell 232G. Photosensitive member rotation count cell 232B stores the number of rotations made by the photosensitive member. Empty-mode-start-time rotation count cell 232C stores the number of rotations at the start of the empty mode. Empty-mode maximum rotation count cell 232D stores the empty-mode maximum number of rotations. Number of rotations per job cell 232E stores the number of rotations per job. Dot-count number per job cell 232F stores the dot-count number per job. Number of printed sheets per job cell 232G stores the number of printed sheets per job.

Referring back to FIG. 11, analyzer 27 according to the second embodiment includes data analyzer 171, damage calculator 272, and monitor 273. Analyzer 27 according to the second embodiment differs from analyzer 17 according to the first embodiment in the processes performed by damage calculator 272.

Damage calculator 272 calculates the damage-progress rate defined as follows. The damage-progress rate is a progress rate up to a serviceability limit point in the empty mode at which further continuous use of an image drum unit in the empty mode may damage the image drum unit. The damage-progress rate varies depending not only on the number of rotations made by the photosensitive member but also on the density of the print of each print job. The progress rate to the serviceability limit point becomes higher in a case where the print is dense than in a case where the print is light. So damage calculator 272 firstly calculates a reference dot-count number, which is used as the reference value of the dot-count number when compared with the dot-count number per job. The reference dot-count number is the maximum number of dots for a print of a predetermined resolution and a predetermined print size. In this second embodiment, the predetermined resolution is 600 DPI which is equal to approximately 24 dots per centimeter as "1 inch=25.4 millimeters". Hence, if the predetermined print size is A4, the reference dot-count number becomes 35000000 dots because the reference dot-count number=the maximum number of dots for an A4-size sheet=210 mm×24 dots/mm×297 mm×24 dots/mm.

Then, damage calculator 272 calculates the damage-progress rate according to the second embodiment with the following formula (2).

[Equation 2]

$$[\{(\text{Number of rotations made by photosensitive member})+(\text{Additional damage value})-(\text{Number at start of empty mode})\}/\{(\text{Empty-mode maximum number of rotations})-(\text{Number of rotations at start of empty mode})\}]\times 100=\text{Damage-progress rate} \quad (2)$$

The additional damage value in Formula (2) is obtained by multiplying the number of rotations per job by an additional damage coefficient, which is determined in accordance with the dot-count number per job. In this second embodiment, the additional damage coefficient is "1" or "0." If the dot-count number per job is larger than the value obtained by multiplying half the reference dot-count number by the number of printed sheets per job, the additional damage coefficient is "1". If, in contrast, the dot-count number per job is equal to or smaller than the value obtained by multiplying half the reference dot-count number by the number of printed sheets per job, the additional damage coefficient is "0".

In the case shown in FIG. 12, the dot-count number per job is 20000000, the number of printed sheets per job is 1, and the additional damage coefficient corresponding to the reference dot-count number of 35000000 is "1." In addition, the number of rotations per job is 100 in the case shown in FIG. 12. Hence, the additional damage value in the case shown in FIG. 12 is 100 (=100×1). Accordingly, following Formula (2), the progress rate of the damage is 30%.

Figure 13:
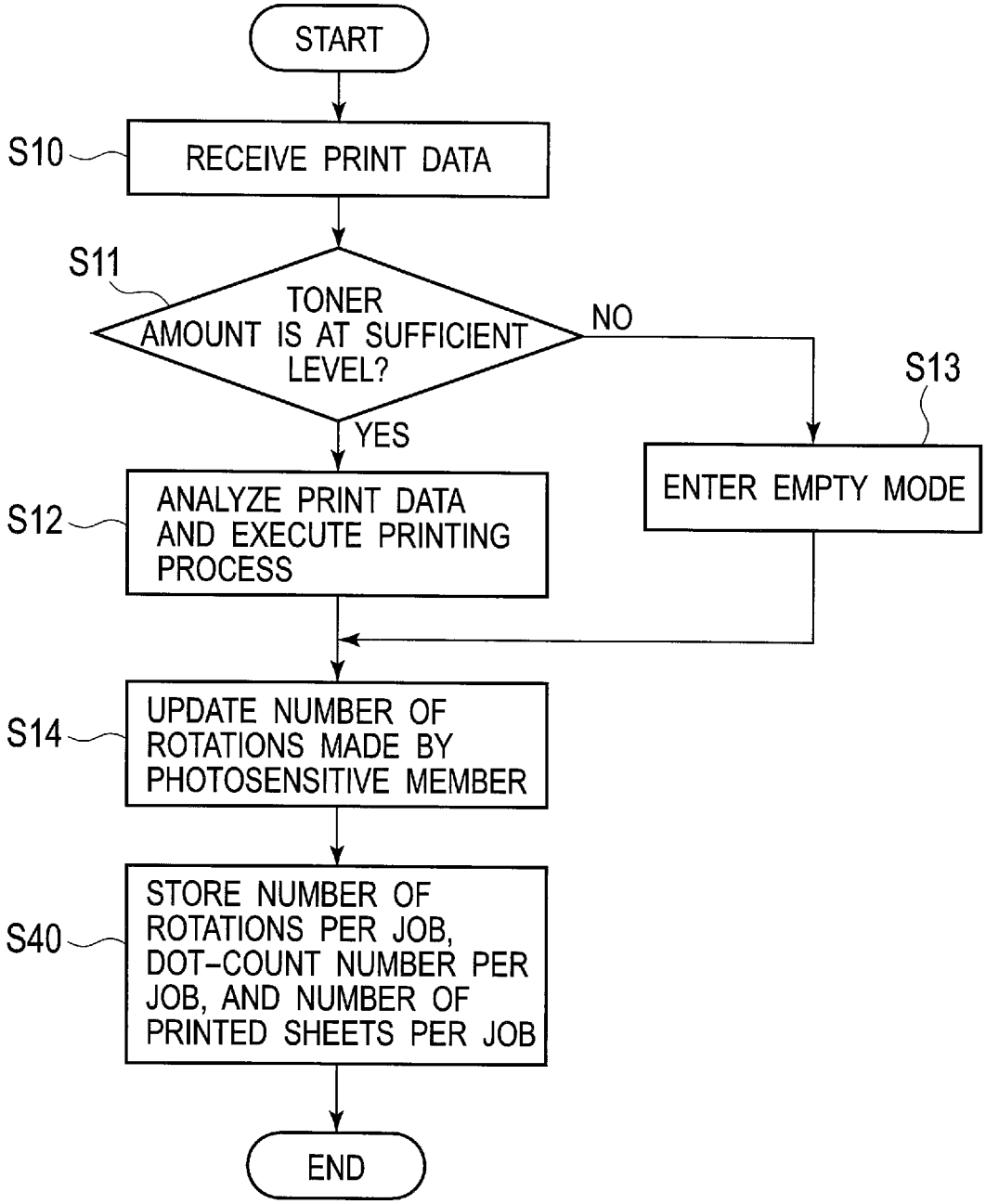
FIG. 13 a flowchart illustrating processes performed by the image formation apparatus according to the second embodiment to detect the toner amount and then switch the operation mode of the image formation apparatus on the basis of the detection result.

FIG. 13 a flowchart illustrating processes performed by image formation apparatus 20 according to the second embodiment to detect the toner amount and then switch the operation mode of image formation apparatus 20 on the basis of the detection result. Note that the steps in the flowchart shown in FIG. 13 that are the same as or similar to the ones in the flowchart shown in FIG. 7 are denoted by the same reference numerals that are used in FIG. 7.

The processes at steps S10 to S12 in FIG. 13 are the same as or similar to the processes at steps S10 to S12 in FIG. 7.

Then if toner-amount detector 12 judges that the detected toner amount is smaller than the toner-amount threshold (No at step S11), controller 21 switches the operation mode of image formation apparatus 20 to the empty mode, and executes the processes in the empty mode (S43). The processes executed in the empty mode will be described in detail later by referring to FIG. 14.

Then, on the basis of the number of rotations made by photosensitive member 1811A at step S12 or at step S43, controller 21 updates the number of rotations made by the photosensitive member, which is stored in counter 232A (S14).

Then, controller 21 identifies the number of rotations per job, the dot-count number per job, and the number of printed sheets per job either at step S12 or at step S43, and then updates these numbers stored in counter 232A (S40).

Figure 14:
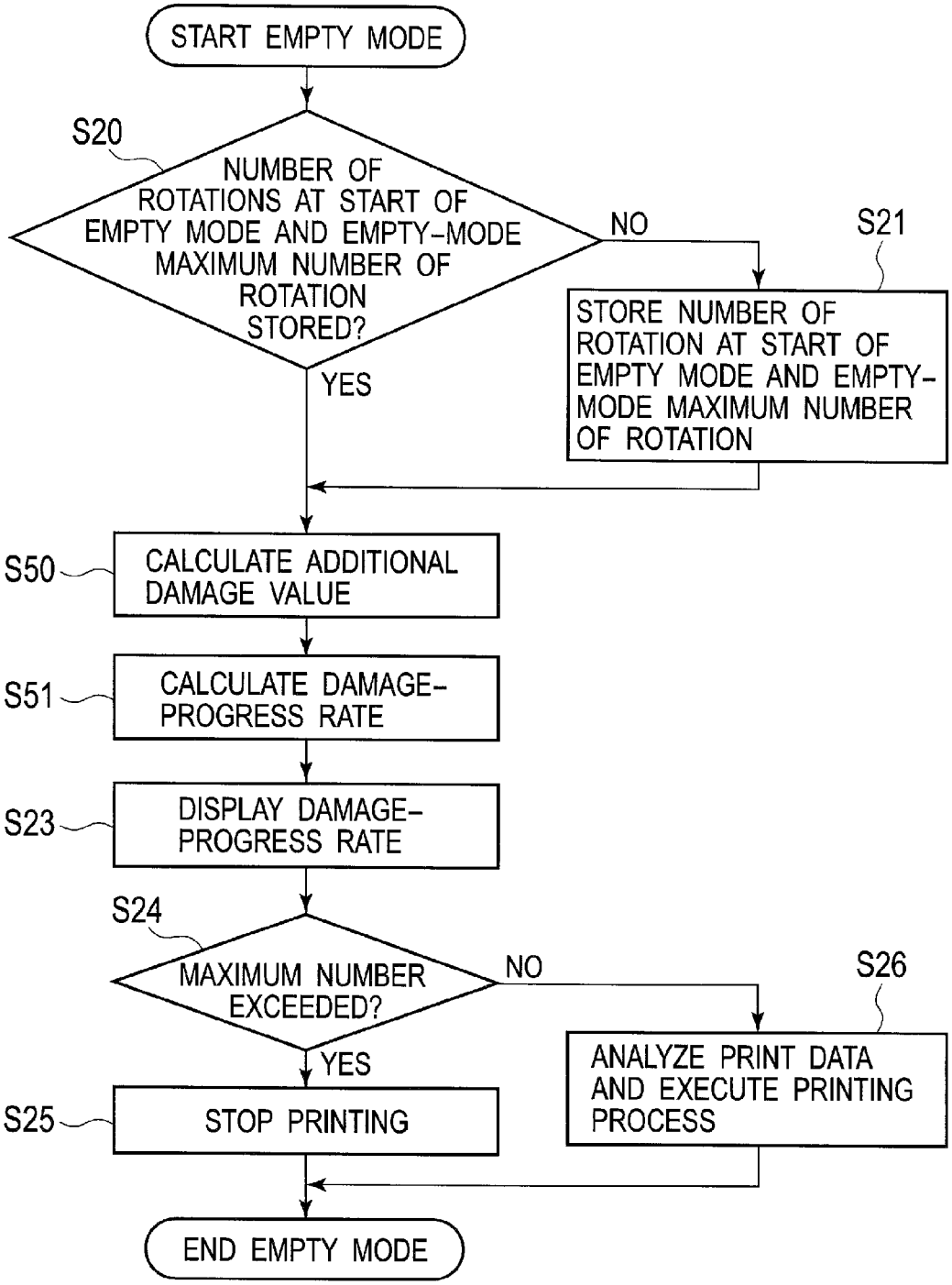
FIG. 14 is a flowchart illustrating processes performed by the image formation apparatus according to the second embodiment when the image formation apparatus is in the empty mode.

FIG. 14 is a flowchart illustrating processes performed by image formation apparatus 20 according to the second embodiment in the empty mode. Note that the steps in the flowchart shown in FIG. 14 that are the same as or similar to the ones in the flowchart shown in FIG. 8 are denoted by the same reference numerals that are used in FIG. 8.

The processes at steps S20 and S21 in FIG. 14 are the same as or similar to the processes at steps S20 and S21 in FIG. 8.

If damage calculator 272 judges that counter 232A stores both the number of rotations at the start of the empty mode and the empty-mode maximum number of rotations (Yes at step S20), or if the process at step S21 is performed, damage calculator 272 calculates the reference dot-count number. In addition, damage calculator 272 also calculates the additional damage value on the basis of the number of rotations per job, the dot-count number per job, and the number of printed sheets per job, stored in counter 232A (S50).

Then, damage calculator 272 calculates the damage-progress rate using Formula (2) described above (S51).

The processes at steps S23 to S26 in FIG. 14 are the same as or similar to the processes at steps S23 to S26 in FIG. 8.

As has been described thus far, when the amount of toner stored in toner cartridge 1812 becomes small, image formation apparatus 20 according to the second embodiment can calculate the damage-progress rate of image drum unit 1811 more accurately by taking into account the number of rotations made by the photosensitive member per job, the dot-count number, and the number of printed sheets. Accordingly, based on the accurate information, the user can prevent the consumption of image drum unit 1811 from progressing too far.

Third Embodiment

Figure 15:
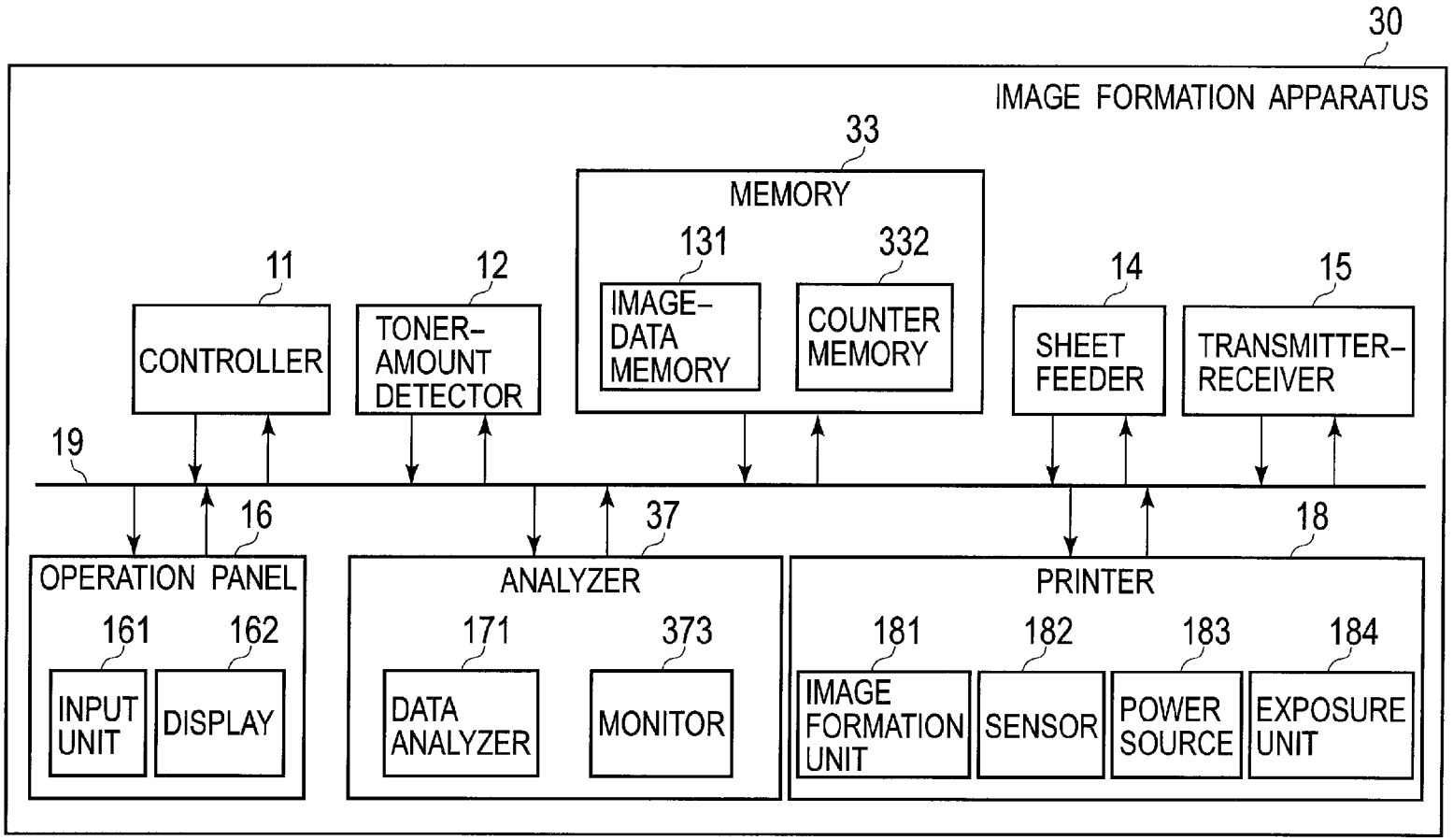
FIG. 15 is a block diagram schematically illustrating the overall configuration of an image formation apparatus according to a third embodiment.

FIG. 15 is a block diagram schematically illustrating the configuration of image formation apparatus 30 according to the third embodiment. As shown in FIG. 15, image formation apparatus 30 includes controller 11, toner-amount detector 12, memory 33, sheet feeder 14, transmitter-receiver 15, operation panel 16, analyzer 37, printer 18, and bus 19 that connects these components to one another. Image formation apparatus 30 according to the third embodiment differs from image formation apparatus 10 according to the first embodiment in that image formation apparatus 30 includes memory 33 and in analyzer 37. In image formation apparatus 30 according to the third embodiment, display unit 162 displays a screen containing information on the consumption rate of an image drum unit when toner-amount detector 12 detects the fact that only a small amount of toner is left in a toner cartridge.

Memory 33 according to the third embodiment includes image-data memory 131 and counter memory 332. Memory 33 according to the third embodiment differs from memory 13 according to the first embodiment in terms of a counter, that is, counter data, stored in counter memory 332.

Counter memory 332 according to the third embodiment stores counter 332A containing information such as that shown in FIG. 16.

FIG. 16 is a schematic diagram illustrating the information configuration of counter 332A. Counter 332A has photosensitive member rotation count cell 332B. Photosensitive member rotation count cell 332B stores the number of rotations made by the photosensitive member.

Referring back to FIG. 15, analyzer 37 according to the third embodiment includes data analyzer 171 and monitor 373. Analyzer 37 according to the third embodiment differs from analyzer 17 according to the first embodiment both in the processes performed by monitor 373 and in the fact that analyzer according to the third embodiment includes no damage calculator 172.

Monitor 373 according to the third embodiment monitors the used condition of image formation apparatus 30. If toner-amount detector 12 detects the fact that the amount of toner in the toner cartridge has become smaller than the threshold, on the basis of the number of rotations made by the photosensitive member kept in counter 332A, monitor 373 creates consumption-rate display screen CRD, such as the one shown in FIG. 5, and makes display unit 162 display consumption-rate display screen CRD thus created.

Figure 17:
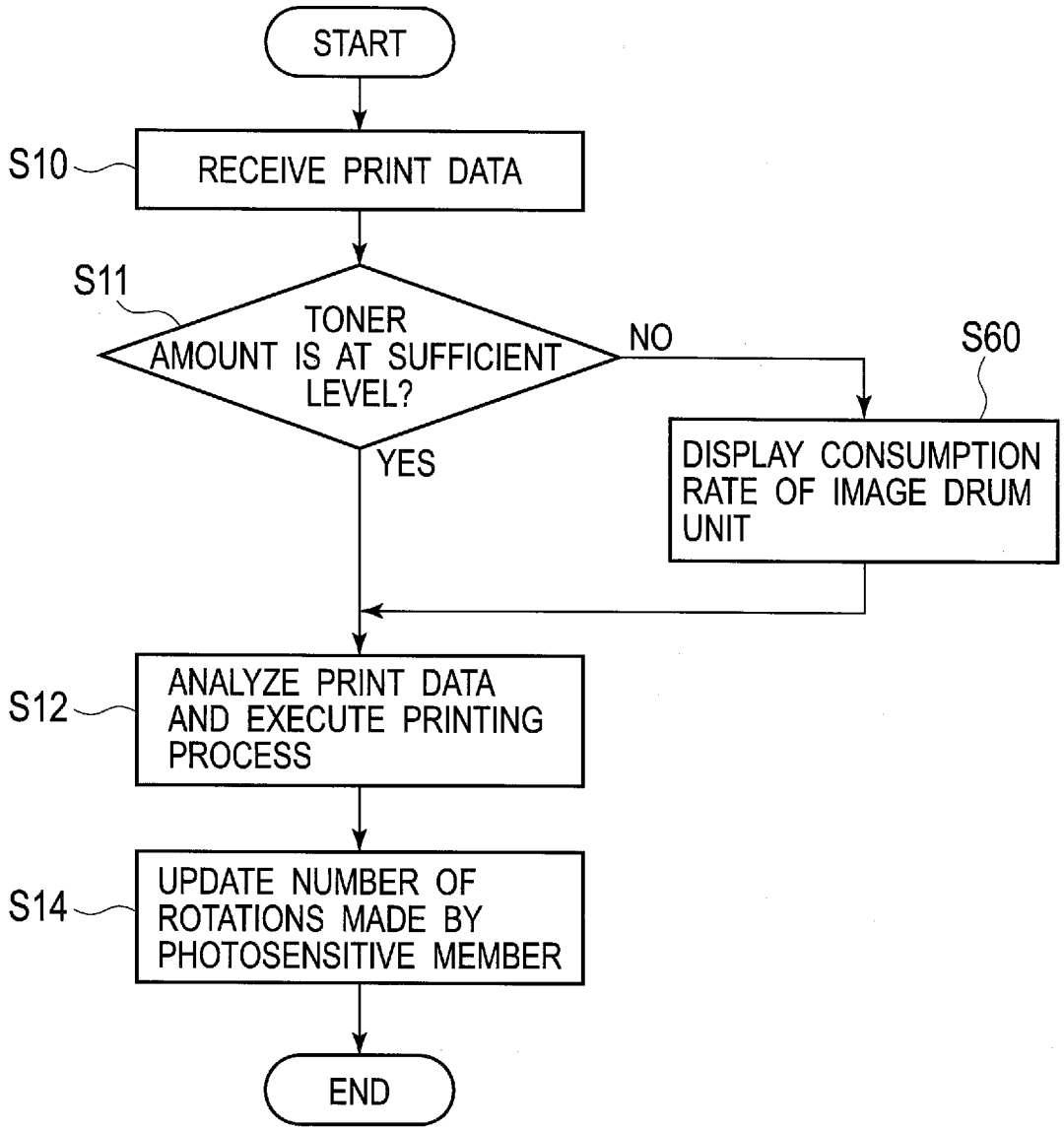
FIG. 17 is a flowchart illustrating processes performed by the image formation apparatus according to the third embodiment.

FIG. 17 is a flowchart illustrating processes performed in image formation apparatus 30 according to the third embodiment. Note that the steps in the flowchart shown in FIG. 17 that are the same as or similar to the ones in the flowchart shown in FIG. 7 are denoted by the same reference numerals that are used in FIG. 7.

The processes at steps S10 to S12 in FIG. 17 are the same as or similar to the processes at steps S10 to S12 in FIG. 7.

If toner-amount detector 12 judges that the detected toner amount is smaller than the toner-amount threshold (No at step S11), Controller 11 switches the operation mode of image formation apparatus 30 to the empty mode. In addition, monitor 373 creates consumption-rate display screen CRD shown in FIG. 5 on the basis of the number of rotations made by the photosensitive member kept in counter 332A. Then, monitor 373 makes display unit 162 display consumption-rate display screen CRD. Note that the maximum number of rotations shown in FIG. 5 (specifically 20000 rotations in this case) is determined beforehand and is stored for example, in memory 33.

Then, on the basis of the number of rotations made by photosensitive member 1811A obtained at step S12, controller 11 updates the number of rotations made by the photosensitive member stored in counter 332A (S61).

As has been described thus far, in image formation apparatus 30 according to the third embodiment, when only a small amount of toner is stored in toner cartridge 1812, the consumption rate of image drum unit 1811 is displayed. So, if the consumption rate is high, image drum unit 1811 can be replaced along with the replacement of toner cartridge 1812.

Modifications

In the second embodiment described earlier, when the image based on the image data received by transmitter-receiver 15 is printed, the additional damage value is calculated on the basis of the number of rotations per job by the photosensitive member, the dot-count number, and the number of printed sheets in the previous print job, and then the damage-progress rate is calculated by adding the additional damage score. The damage-progress rate, however, is not necessarily calculated in this way. Alternatively, for example, the damage-progress rate may be calculated by adding the accumulated value of the additional damage scores obtained in the empty mode. In this case, counter memory 232 stores counter 432A such as the one containing information as shown in FIG. 18. Counter 432A is a counter that includes an accumulated value of the additional damage value cell 432H in addition to all the cells included in counter 232A shown in FIG. 12. Then, controller 21 updates, at step S40 in FIG. 13, the number of rotations per job, the dot-count number per job, and the number of printed sheets per job only when the printing in the empty mode is performed at step S43. Then, damage calculator 272 adds the additional damage value calculated at step S50 in FIG. 14 to the value stored in cell 432H where the accumulated additional damage value is recorded. Then, damage calculator 272 calculates the damage-progress rate by Formula (2) at step S51 in FIG. 14 in which the accumulated additional damage value is used in place of the additional damage value. In addition, after performing the process at step S32 in FIG. 10, monitor 173 puts a value "0" in the number of rotations per job cell 432E, dot-count number per job cell 432F, the number of printed sheets per job cell 432G, and the accumulated additional damage value cell 432H. With the processes described above, the same progress rate of image drum unit 1811 can be calculated more accurately on the basis of the accumulated additional damage value obtained in the empty mode.

Fourth Embodiment

Figure 19:
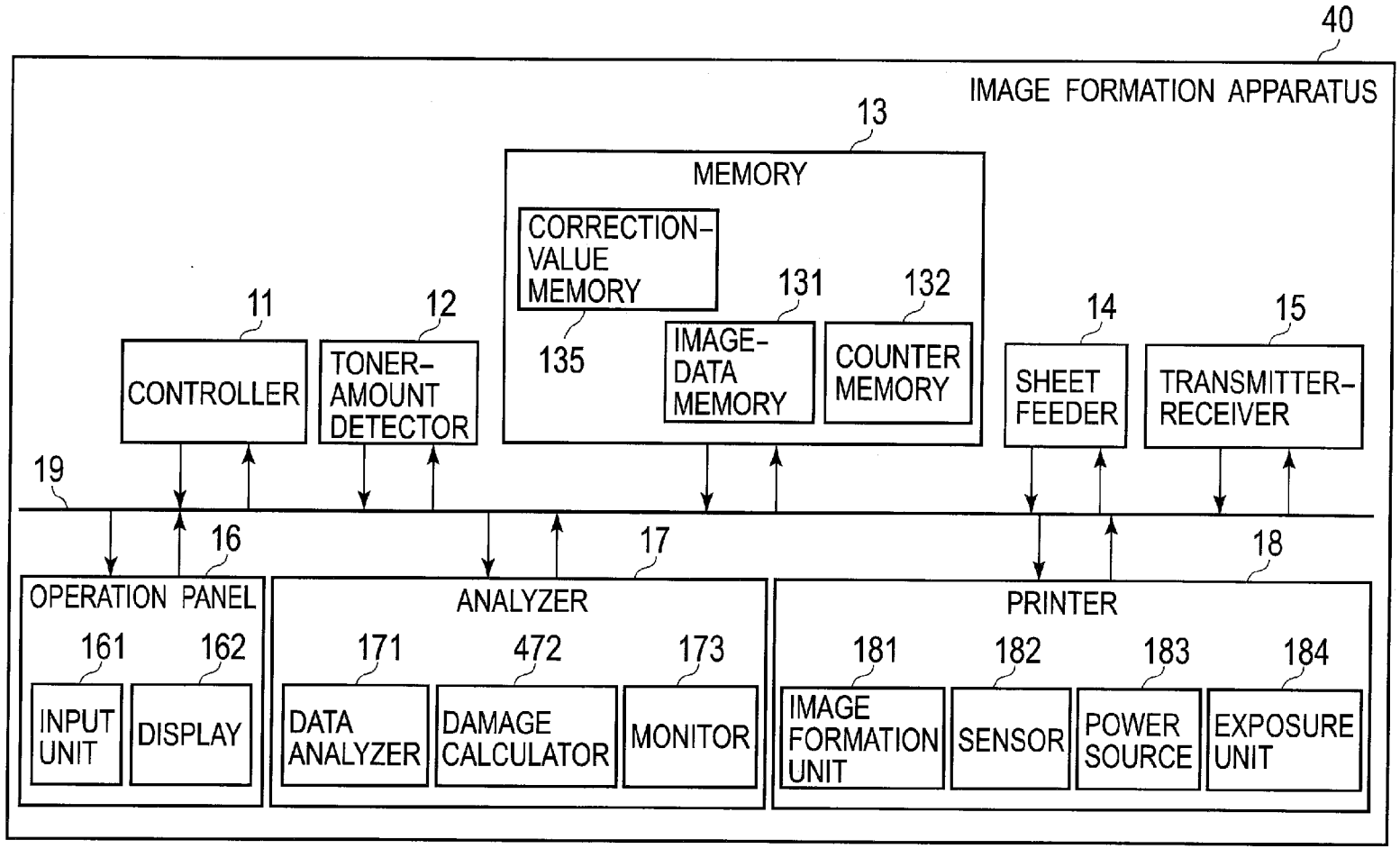
FIG. 19 is a block diagram schematically illustrating the overall configuration of an image formation apparatus according to a fourth embodiment.

FIG. 19 is a block diagram schematically illustrating the configuration of image formation apparatus 40 according to a fourth embodiment. Memory 13 includes correction-value memory 135, where a correction value α and β are stored. The correction value α is a weight used in the correction of the number of rotations made by the photosensitive member. In this fourth embodiment, the correction value α is 10 and the correction value β is 1. In the empty mode, damage calculator 472 corrects the number of rotations of the photosensitive member during the empty mode, by multiplying the number by the correction value α.

In this fourth embodiment, the same value (20000 rotations) is used as the maximum number of rotations made by the photosensitive-member drum both in the normal mode and in the empty mode.

Figure 20:
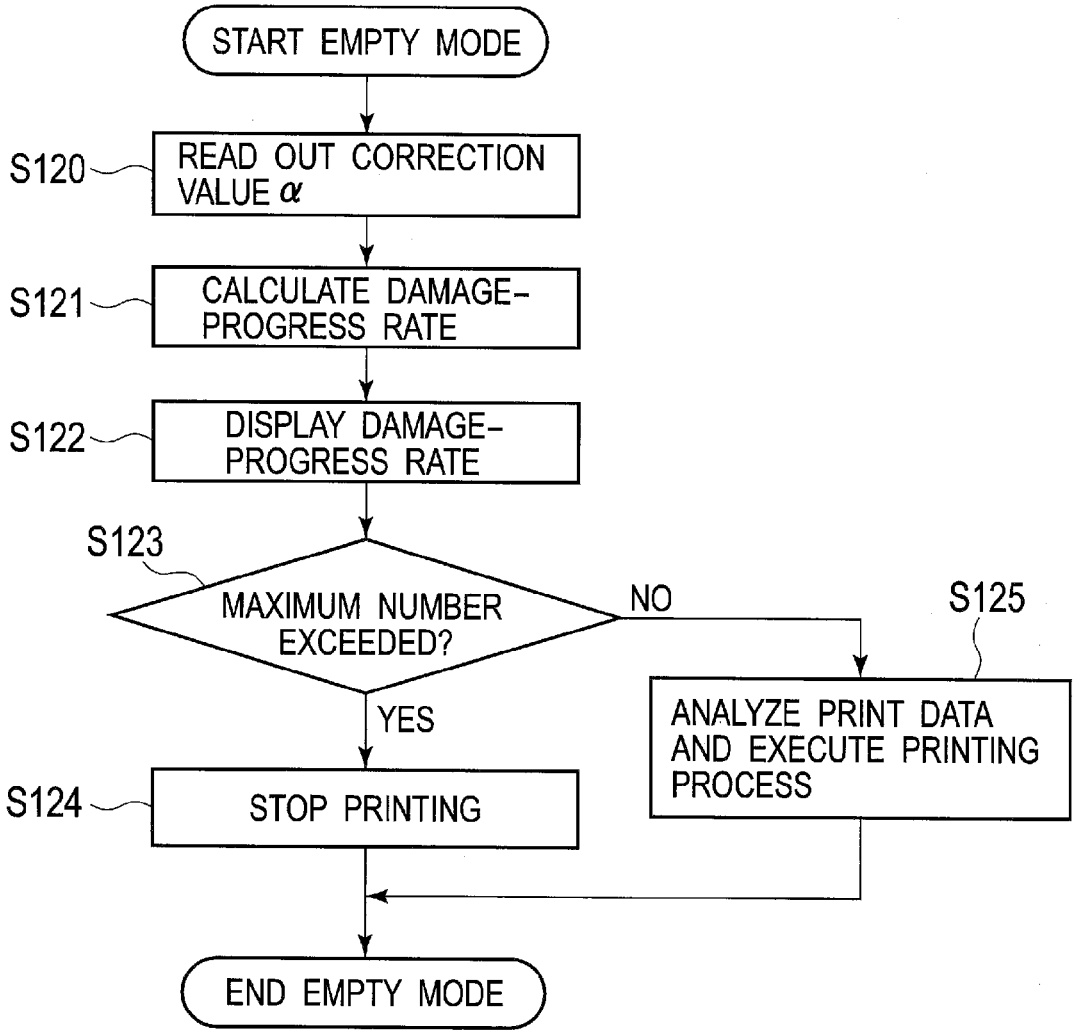
FIG. 20 is a flowchart illustrating a series of processes performed by the image formation apparatus according to the fourth embodiment when the image formation apparatus is in the empty mode.

FIG. 20 is a flowchart illustrating processes performed in the empty mode. Note that, upon the start of the empty mode, the number stored in cell 132F is input to and stored in cell 132G.

Firstly, damage calculator 472 reads out the correction values α and β from correction-value memory 135 (S120). Then, damage calculator 472 calculates the damage-progress rate of image drum unit 1811 on the basis of the numbers stored in cells 132F, 132G, and 132H in counter 132E in FIG. 21 (the number of rotations made by the photosensitive member (13400 rotations in this example), the number of rotations of the photosensitive member the at the start of the empty mode (13000 rotations in this example), and the maximum number of rotations (20000 rotations in this example)), as well as on the correction values α and β read out at S30 (S121). The damage-progress rate is calculated by using, for example, the following formula where α>β (e.g. values α and β are 10 and 1, respectively, in the embodiment).

{[(Number of rotations made by photosensitive member during normal mode)×correction value β+(Number of rotations made by photosensitive member during empty mode)×correction value α]×100}/Maximum number of rotations=Damage-progress rate Then, monitor 173 makes display unit 162 display the used condition of image formation apparatus 40, that is, the damage-progress rate of image drum unit 1811 calculated by damage calculator 472 at step S121 (S122). For example, monitor 173 makes display unit 162 display information screen IFD such as one shown in FIG. 6. At that time, monitor 173 preferably makes display unit 162 display not only information screen IFD shown in FIG. 6 but also consumption-rate display screen CRD such as one shown in FIG. 5, either alternately or simultaneously.

Then, monitor 173 judges whether or not the number of rotations made by the photosensitive member exceeds the maximum number of rotations (S123). For example, if the damage-progress rate calculated at step S121 is equal to or higher than 100%, monitor 173 judges that the number of rotations in the empty mode exceeds the maximum value.

Then, if monitor 173 judges that the number of rotations exceeds the maximum number (Yes at step S123), controller 11 stops printing the print image based on the image data received by transmitter-receiver 15 (S124). Hence, Controller 11 stops the printing before image drum unit 1811 is damaged. Thus, also in this fourth embodiment, image drum unit 1811 is not damaged in the empty mode. Hence, even after the operation mode returns to the normal mode from the empty mode by refilling the toner, the consumption rate of image drum unit 1811 can be calculated on the basis of the number of rotations made by photosensitive member 1811A.

If, in contrast, monitor 173 judges that the number of rotations in the empty mode does not exceed the maximum value (No at step S123), the data analyzer 171 analyzes the image data received by transmitter-receiver 15, and then printer 18 prints the print image based on the analyzed image data (S125).

Figure 22:
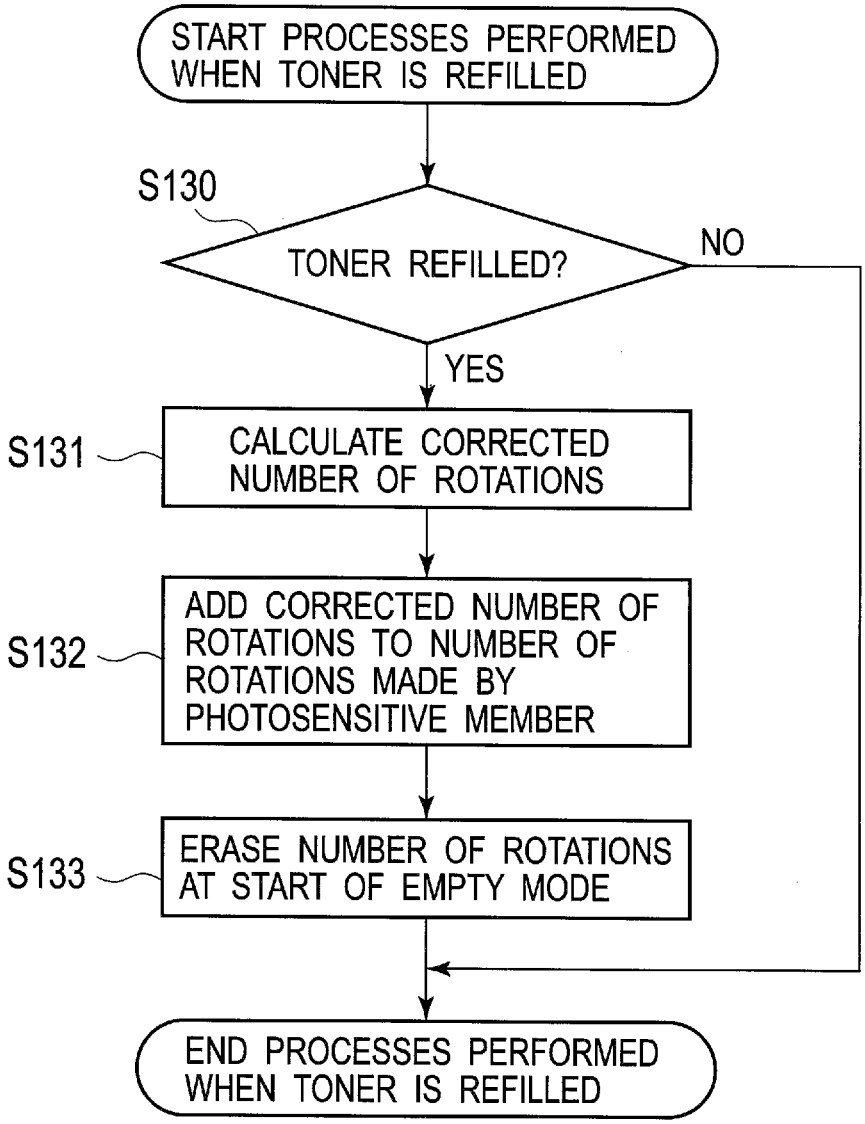
FIG. 22 is a flowchart illustrating processes performed when toner cartridge is refilled with toner according to the fourth embodiment.

FIG. 22 is a flowchart illustrating processes performed when toner cartridge 1812 is refilled with toner. Toner-amount detector 12 detects the amount of toner stored in toner cartridge 1812, and judges whether or not the detected toner amount is not smaller than the toner-amount threshold described earlier (S130).

If, at step S130, toner-amount detector 12 judges that the amount of toner is not smaller than the toner-amount threshold (Yes at S130), monitor 173 calculates the corrected number of rotations by multiplying, by the correction value α, the number of rotations of photosensitive member 1811A in the empty mode (S131). To be more specific, the corrected number of rotations is obtained by subtracting the number stored in cell 132G (the number of rotations at the start of the empty mode) from the number stored in cell 132F (the number of rotations made by the photosensitive member), and then by multiplying the remainder by the correction value α. Then, the corrected number of rotations is added to the number stored in cell 132F (the number of rotations made by the photosensitive member) (S132). Then, the number stored in cell 132G (the number of rotations at the start of the empty mode) is erased (S133). Then, monitor 173 terminates the processes.

If, in contrast, toner-amount detector 12 judges at step S130 that the toner amount is smaller than the toner-amount threshold (No at S130), then, monitor 173 terminates the processes.

That is, when the toner is refilled after the empty mode is started (e.g. when image formation apparatus 40 is recovered from the empty mode by replacing toner cartridge 1812) in this fourth embodiment, the number stored in cell 132F in counter 132E (the number of rotations made by the photosensitive member) is replaced, not with the actual number of rotations made by the photosensitive member after the start of using the photosensitive member, but with a value obtained by adding the number of rotations made by photosensitive member 1811A during the normal mode to the product of the following multiplication: the number of rotations made by photosensitive member 1811A during the empty mode×the correction value α. Then, based on the replaced number of rotations made by the photosensitive member stored in cell 132F in counter 132E, the consumption rate is calculated and displayed in consumption-rate display screen CRD.

According to the fourth embodiment, during the empty mode, the damage rate of image drum unit 1811 can be calculated and displayed accurately by weighting, as in this fourth embodiment, the number of rotations of photosensitive member 1811A in the empty mode.

According to the fourth embodiment, after the apparatus is recovered from the empty mode, the consumption rate of image drum unit 1811 can be calculated and displayed more accurately, by replacing the number of rotations stored in cell 132F in counter 132E.

Image formation apparatuses 10, 20, 30, and 40 can be printers, fax machines, photocopiers, multifunction printers, or the like. As regards the type of printing, any types of printing can be employed, such as ink-jet, electrophotographic, and thermal transfer printing.

In the first and the second embodiments described above, display unit 162 displays information screen IFD shown in FIG. 6. Information screen IFD to be displayed does not have to be the one shown in FIG. 6. Alternatively, for example, information screen IFD may include at least one of an alert display such as an error display or a warning display intended to alert the user to the fact that only a small amount of toner is left and an operation display that prompts the user to refill the toner.

In the first and the second embodiments described above, the damage-progress rate is calculated on the basis of the number of rotations made by photosensitive member 1811A. Alternatively, the damage-progress rate may be calculated on the basis of the number of rotations made by charger roller 1811B, development roller 1811C, or toner-supply roller 1811E.

In the first to the third embodiments described above, the consumption rate of the image drum unit is identified on the basis of the number of rotations made by photosensitive member 1811A. Alternatively, the consumption rate of the image drum unit may be identified on the basis of the number of rotations made by charger roller 1811B, development roller 1811C, or toner-supply roller 1811E. Still alternatively, the consumption rate of the image drum unit may be identified on the basis of the number of printed pages, the printed dot-count number, how long transfer belt 2 has been used, or how long photosensitive member 1811A has been used.

In the first and the second embodiments described above, the damage-progress rate of image drum unit 1811 and the consumption rate of image drum unit 1811 are calculated by taking up image drum unit 1811 as an example of a consumable component other than the toner. Alternatively, any other parts may be taken up as examples of consumable components other than the toner. For example, the damage-progress rate and the consumption rate may be calculated for photosensitive member 1811A, charger roller 1811B, development roller 1811C, toner-supply roller 1811E, or the like.

In the second embodiment described above, the reference dot-count number is defined as the maximum number of dots for a sheet of A4 size. Alternatively, the reference dot-count number is defined as the maximum number of dots for a sheet of other sizes. Still alternatively, every time the printing is performed, the reference dot-count number may be defined as the maximum number of dots for a sheet of a particular size in the print job.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus to form an image on a print medium, comprising:

a toner cartridge in which toner can be accommodated;

a toner-amount detector configured to detect a toner amount in the toner cartridge;

a display unit;

an analyzer configured to make the display unit display a used condition of the image formation apparatus, when the image formation apparatus is in a small-amount mode where the toner amount is smaller than a threshold;

a photosensitive member configured to retain toner image thereon;

a storage configured to store therein a number of rotations of the photosensitive member; and a consumed-amount calculation unit configured to perform a first consumed-amount calculation mode for calculating a consumed amount of the photosensitive member in a normal mode in which the toner amount is equal to or greater than the threshold, and a second consumed-amount calculation mode for calculating the consumed amount of the photosensitive member in the small-amount mode in which the toner amount is smaller than the threshold, such that the consumed amount of the photosensitive member is calculated at a higher rate of increment in the second consumed-amount calculation mode than in the first consumed-amount calculation mode.

2. The image formation apparatus according to claim 1, wherein the used condition of the image formation apparatus includes the consumed amount of the photosensitive member.

3. The image formation apparatus according to claim 2, wherein the consumed amount is calculated as a progress rate to a serviceability limit point of the photosensitive member.

4. The image formation apparatus according to claim 3, further comprising a controller configured to stop formation of an image when the progress rate becomes equal to or higher than a predetermined value.

5. The image formation apparatus according to claim 3, wherein the photosensitive member rotates when an image is formed.

6. The image formation apparatus according to claim 5, wherein the progress rate becomes higher with an increase in a number of rotations of the photosensitive member.

7. The image formation apparatus according to claim 6, wherein the analyzer calculates the progress rate on the basis of the number of rotations of the photosensitive member in the small-amount mode.

8. The image formation apparatus according to claim 6, wherein the progress rate is a proportion of the number of rotations made by the photosensitive member in the small-amount mode to a predetermined maximum number of rotations for the photosensitive member in the small-amount mode.

9. The image formation apparatus according to claim 3, wherein the analyzer includes a calculator configured to calculate the progress rate.

10. The image formation apparatus according to claim 2, wherein the consumed amount is calculated as a progress rate to a serviceability limit in the small-amount mode, wherein the serviceability limit point is a point at which further continuous use of the photosensitive member in the small-amount mode may damage the photosensitive member.

11. The image formation apparatus according to claim 2, wherein the used condition of the consumable component other than the toner is a consumption rate of the photosensitive member.

12. The image formation apparatus according to claim 1, wherein the consumption rate becomes higher with an increase in the number of rotations made by the photosensitive member after a start of using the photosensitive member.

13. The image formation apparatus according to claim 1, wherein the consumption rate is calculated on the basis of a first number of rotations that is the number of rotations of the photosensitive member in a normal mode where the toner amount is not lower than the threshold, and a second number of rotations that is the number of rotations of the photosensitive member in the small-amount mode.

14. An image formation apparatus to form an image on a print medium, comprising:

a toner cartridge in which toner can be accommodated;

a toner-amount detector configured to detect a toner amount in the toner cartridge;

a display unit;

an analyzer configured to make the display unit display a used condition of the image formation apparatus, when the image formation apparatus is in a small-amount mode where the toner amount is smaller than a threshold; and a rotary member;

wherein the used condition of the image formation apparatus includes a used condition of the rotary member;

wherein the used condition of the rotary member is a consumption rate of the rotary member, wherein the consumption rate is calculated on the basis of a first number of rotations that is the number of rotations of the rotary member in a normal mode where the toner amount is not lower than the threshold, and a second number of rotations that is the number of rotations of the rotary member in the small-amount mode, and wherein the consumption rate is calculated based on a following expression:

(the first number of rotations×a correction value $\beta$)+ (the second number of rotations×a correction value $\alpha$), where $\alpha>\beta$

15. An image formation apparatus configured to form an image on a print medium comprising:

a toner cartridge in which toner can be accommodated;

a consumable component other than the toner;

a toner-amount detector configured to detect a toner amount in the toner cartridge;

an analyzer configured to calculate a progress rate to a serviceability limit point that corresponds to a consumed amount of a photosensitive member in a small-amount mode where the amount of toner is smaller than a threshold, wherein the serviceability limit point is a point at which further continuous use of the consumable component other than the toner in the small-amount mode may damage the consumable component other than the toner; and a controller configured to stop the formation of the image when the progress rate becomes equal to or higher than a predetermined value;

the photosensitive member configured to retain toner image thereon;

a storage configured to store therein a number of rotations of the photosensitive member; and a consumed-amount calculation unit configured to perform a first consumed-amount calculation mode for calculating a consumed amount of the photosensitive member in a normal mode in which the toner amount is equal to or greater than the threshold, and a second consumed-amount calculation mode for calculating the consumed amount of the photosensitive member in the small-amount mode in which the toner amount is smaller than the threshold, such that the consumed amount of the photosensitive member is calculated at a higher rate of increment in the second consumed-amount calculation mode than in the first consumed-amount calculation mode.

16. An image formation apparatus to form an image on a print medium, comprising:

a toner cartridge in which toner can be accommodated;

a toner-amount detector configured to detect a toner amount in the toner cartridge;

a display unit;

an analyzer configured to make the display unit display a used condition of the image formation apparatus, when the image formation apparatus is in a small-amount mode where the toner amount is smaller than a threshold;

a photosensitive member configured to retain toner image thereon;

a first consumed amount calculation unit configured to calculate a consumed amount of the photosensitive member in a normal mode where the toner amount is equal to or higher than the threshold, and a second consumed amount calculation unit configured to calculate a consumed amount of the photosensitive member in the small-amount mode where the toner amount is smaller than the threshold, wherein the used condition of the image formation apparatus includes a used condition of the photosensitive member, wherein the photosensitive member rotates when an image is formed, wherein the consumed amount becomes higher with an increase in a number of rotations of the photosensitive member, wherein the consumed amount is calculated by the second consumed amount calculation unit when the image forming apparatus is operating in the small-amount mode on the basis of the number of rotations made by the photosensitive member in the small-amount mode and on a number of dots formed on the photosensitive member, and wherein the consumed amount is calculated by the first consumed amount calculation unit when the image forming apparatus is operating in the normal mode on the basis of the number of rotations made by the photosensitive member in the normal mode and not on the number of dots formed on the photosensitive member.

* * * * *